US009242814B2

(12) United States Patent
Ichikawa et al.

(10) Patent No.: US 9,242,814 B2
(45) Date of Patent: Jan. 26, 2016

(54) IMAGE PROCESSING APPARATUS, CONTROLLING METHOD THEREOF, AND COMPUTER-READABLE MEDIUM FOR CONTROLLING TORQUE APPLIED TO A SEPARATION ROLLER OF IMAGE PROCESSING APPARATUS

(71) Applicant: BROTHER KOGYO KABUSHIKI KAISHA, Nagoya-shi, Aichi-ken (JP)

(72) Inventors: Hiroshi Ichikawa, Okazaki (JP); Yasuyuki Otsuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/575,410

(22) Filed: Dec. 18, 2014

(65) Prior Publication Data

US 2015/0175367 A1 Jun. 25, 2015

(30) Foreign Application Priority Data

Dec. 19, 2013 (JP) ..... 2013-262547

(51) Int. Cl.

| | |
|---|---|
| ***G06F 15/00*** | (2006.01) |
| ***G06K 1/00*** | (2006.01) |
| ***G06K 15/00*** | (2006.01) |
| ***B65H 3/06*** | (2006.01) |
| ***B65H 7/06*** | (2006.01) |
| ***B65H 5/06*** | (2006.01) |
| ***B65H 7/20*** | (2006.01) |

(52) U.S. Cl.

CPC ..... *B65H 3/06* (2013.01); *B65H 3/0669* (2013.01); *B65H 5/062* (2013.01); *B65H 7/06* (2013.01); *B65H 7/20* (2013.01)

(58) Field of Classification Search

USPC ..... 358/1.1–1.15

See application file for complete search history.

(56) References Cited

U.S. PATENT DOCUMENTS

| | | | | |
|---|---|---|---|---|
| 8,573,587 | B2 * | 11/2013 | Yoshinaga | 271/117 |
| 8,616,544 | B2 * | 12/2013 | Katayama et al. | 271/109 |

FOREIGN PATENT DOCUMENTS

| | | | |
|---|---|---|---|
| JP | 2008-174390 | A | 7/2008 |
| JP | 2012211002 | A | 11/2012 |

* cited by examiner

*Primary Examiner* — Douglas Tran

(74) *Attorney, Agent, or Firm* — Merchant & Gould PC

(57) ABSTRACT

Torque is applied to a separation roller of an image processing apparatus when a leading edge of the sheet in a transport direction reaches a first transport roller and when the leading edge of the sheet in the transport direction reaches a transport unit. Torque to the separation roller is cut off after the leading edge of the sheet has reached the transport unit but before the leading edge of the sheet reaches the image processing unit.

14 Claims, 14 Drawing Sheets

IMAGE PROCESSING APPARATUS, CONTROLLING METHOD THEREOF, AND COMPUTER-READABLE MEDIUM FOR CONTROLLING TORQUE APPLIED TO A SEPARATION ROLLER OF IMAGE PROCESSING APPARATUS

CROSS-REFERENCE TO RELATED APPLICATION

This application claims priority from Japanese Patent Application No. 2013-262547, filed on Dec. 19, 2013, which is incorporated herein by reference in its entirety.

TECHNICAL FIELD

Aspects described herein relate to an image processing apparatus, a method of the image processing apparatus, and a non-transitory computer-readable medium for controlling image processing apparatus.

BACKGROUND

In an image forming apparatus, sheets such as paper need to be fed sheet by sheet to an image forming unit. Accordingly, for example, an image forming apparatus is known that is provided with a separation mechanism including a separation roller and a frictional resistance body, such as a separation pad or the like, that separates a plurality of sheets from each other and that feeds the sheets sheet by sheet to an image forming unit.

The separation roller rotates while in contact with the sheet to give transporting force to the sheet. The frictional resistance body is disposed at a position opposing the separation roller and gives frictional resistance to the sheet. Accordingly, only the sheet that is in contact with the separation roller is fed and the other sheets are stopped by frictional resistance without being fed.

A roller mechanism for transporting a sheet typically gives transporting force to the sheet by pinching the sheet from both the front and back side; accordingly, the roller mechanism is provided with a first transport roller and a second transport roller. The first transport roller and the second transport roller extend entirely across the sheet transport path in the width direction.

The second transport roller is capable of being displaced in a direction moving away and moving towards the first transport roller. Furthermore, in order to increase a contact pressure (hereinafter, also referred to as a nip pressure) between the first transport roller and the second transport roller, two end sides of the second transport roller in the shaft direction are pressed towards the first transport roller side with pressing members such as springs.

However, since the pressing members press the two end sides of the second transport roller in the shaft direction, the nip pressure becomes smaller the nearer to the middle of the second transport roller in the shaft direction. Accordingly, when a sheet with a small width is transported, the sheet cannot be nipped with a high nip pressure and, further, frictional resistance from the frictional resistance body acts on the sheet. Therefore, when a sheet with a small width is transported, transport failures such as the sheet being transported out of position at an angle easily occur.

SUMMARY OF THE INVENTION

In general, the present disclosure relates to systems and methods of operation of an image processing device. In some cases, the systems and methods disclosed assist in suppressing occurrence of sheet transport failures.

In order to achieve the object described above, aspects of the present disclosure describe an image processing apparatus. The image processing apparatus may include an image processing unit disposed along a transport path, a separation roller located along the transport path, and a frictional resistance body that is disposed at a position across the transport path from and opposing the separation roller. The image processing apparatus may also include a first transport roller including a first roller portion and a first shaft portion that holds the first roller portion, the first transport roller being provided along the transport path downstream of the separation roller, the first shaft portion extending entirely across the transport path in a width direction. The image processing apparatus may also include a second transport roller displaceably positioned across the transport path from the first transport roller to cooperatively nip the sheet, the second transport roller including a second roller portion and a second shaft portion that holds the second roller portion, the second shaft portion extending entirely across the transport path in the width direction and being displaceable away from and towards the first transport roller, and a pair of pressing members configured to press ends sides of the second transport roller towards the first transport roller. The image processing apparatus may include a transport unit that is located downstream of the first transport roller along the transport path, wherein at least a portion of the transport unit is located upstream of the image processing unit along the transport path, and a drive controller configured to control the separation roller in a first control mode. In the first control mode, the drive controller is configured to apply torque to the separation roller when a leading edge of the sheet in a transport direction reaches the first transport roller and when the leading edge of the sheet in the transport direction reaches the transport unit, and cut off torque to the separation roller after the leading edge of the sheet has reached the transport unit but before the leading edge of the sheet reaches the image processing unit.

Aspects of the disclosure also include a method of operation of an image processing apparatus. The method may include applying torque to a separation roller located along a transport path and across from an opposing frictional resistance body when a leading edge of a sheet in a transport direction reaches a first transport roller provided along the transport path downstream of the separation roller and when the leading edge of the sheet in the transport direction reaches a transport unit located downstream of the first transport roller, the first transport roller including a first roller portion and a first shaft portion that holds the first roller portion, the first shaft portion extending entirely across the transport path in a width direction, the first transport roller cooperating with a second transport roller displaceably positioned across the transport path from the first transport roller to nip the sheet. The method may also include cutting off torque to the separation roller after the leading edge of the sheet has reached the transport unit but before the leading edge of the sheet reaches an image processing unit of the image processing device.

Aspects of the disclosure further include non-transitory, computer-readable medium storing computer-readable instructions therein. When executed by at least one processor of an image processing apparatus, the computer-readable instructions may instruct the image processing apparatus to execute certain steps. The computer-readable instructions may instruct the image processing apparatus to apply torque to a separation roller located along a transport path and across from an opposing frictional resistance body when a leading edge of a sheet in a transport direction reaches a first transport roller provided along the transport path downstream of the separation roller and when the leading edge of the sheet in the transport direction reaches a transport unit located downstream of the first transport roller, the first transport roller including a first roller portion and a first shaft portion that holds the first roller portion, the first shaft portion extending entirely across the transport path in a width direction, the first transport roller cooperating with a second transport roller displaceably positioned across the transport path from the first transport roller to nip the sheet. The computer-readable instructions may also instruct the image processing apparatus to cut off torque to the separation roller after the leading edge of the sheet has reached the transport unit but before the leading edge of the sheet reaches an image processing unit of the image processing device.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
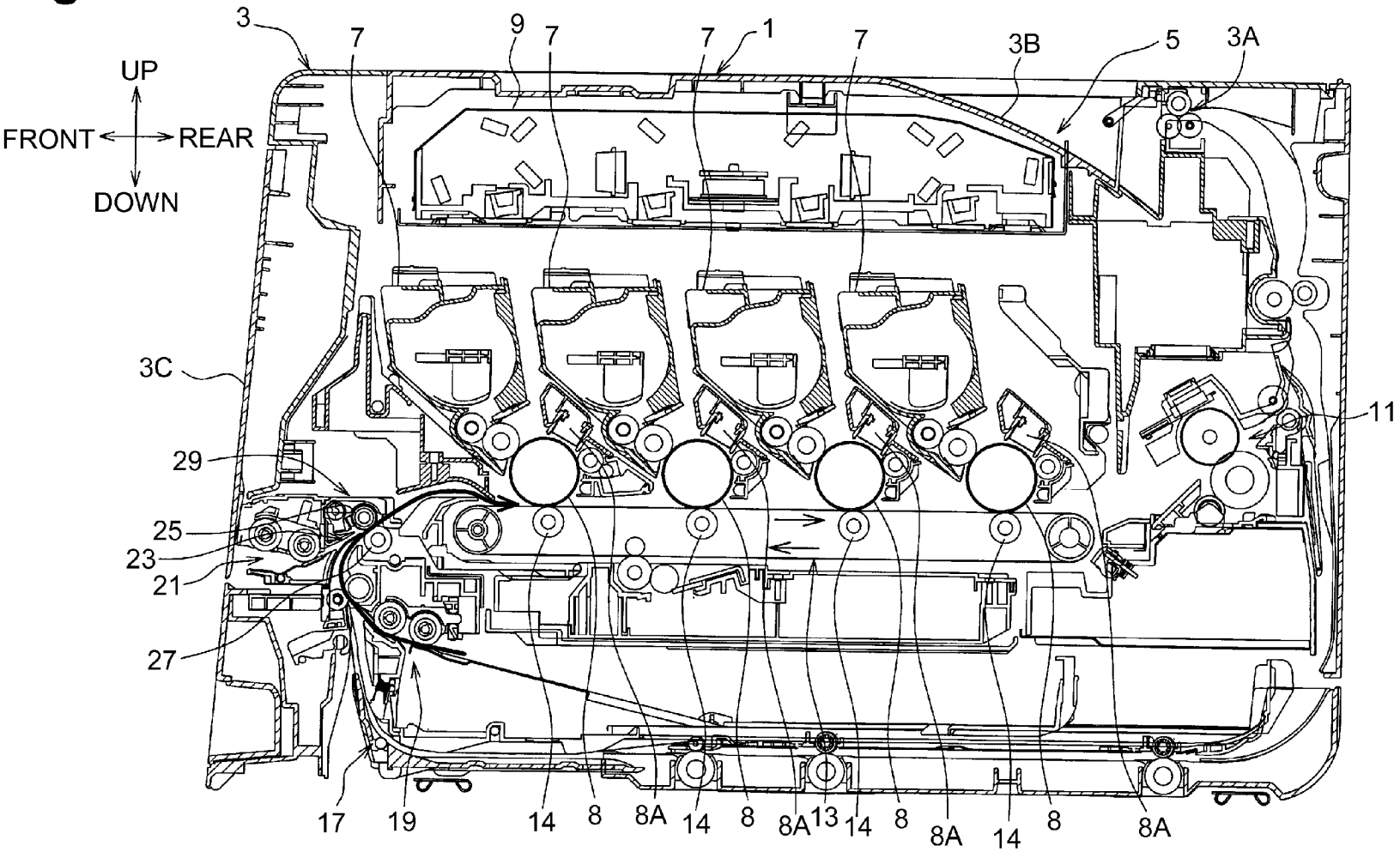
FIG. 1 is a middle cross-sectional view of an example image forming apparatus in the first illustrative embodiment according to one or more aspects of the disclosure.

Various embodiments will be described in detail with reference to the drawings, wherein like reference numerals represent like parts. Reference to various embodiments does not limit the scope of the claims attached hereto, and the disclosure is not limited to the specific means and the like that are illustrated by the reference numerals in the parentheses. Furthermore, the arrows and the like for indicating directions that are added to each of the drawings are illustrated to facilitate understanding of the relationships among the drawings. The disclosure is not limited to the directions added to each of the drawings. Additionally, any example set forth in the specification are not intended to be limiting and merely set forth some of the many possible embodiments for the appended claims.

A first illustrative embodiment is an electrophotographic image forming apparatus to which the present invention has been applied. According to some example aspects of the present disclosure, reduction in occurrences of transport failure in an image processing apparatus, such as an electrophotographic image forming apparatus, are provided. Such transport failures can be suppressed with the transporting force given to the sheet from the separation roller even if frictional resistance from the frictional resistance body acts on the sheet, such as when the sheet cannot be nipped with a large nip pressure.

As regards the number of components and parts described with reference numerals at least, unless notified that there are "a plurality of" or "more than two", at least one is provided. Hereinafter, the embodiments of the disclosure will be described together with the drawings.

As illustrated in FIG. 1, an electrophotographic image forming unit 5 that may form an image on a sheet such as paper may be housed inside a housing 3 of an image forming apparatus 1. The image forming unit 5 may include developing cartridges 7, photosensitive drums 8, chargers 8A, an exposure unit 9, and a fixing unit 11.

A developer may be stored in each of the plurality of developing cartridges 7. The developers stored in the developing cartridges 7 may be yellow, magenta, cyan, and black in this order, from one end side (the front side in the present embodiment) of the developing cartridges 7 in the arrangement direction to the other end side (the rear side in the present embodiment) of the developing cartridges 7 in the arrangement direction.

A plurality of photosensitive drums 8 and chargers 8A may be provided so as to correspond to the developing cartridges 7. Each of the photosensitive drums 8 may carry a developer image. Each charger 8A may charge a corresponding photosensitive drum 8. The exposure unit 9 may expose each of the charged photosensitive drums 8.

An electrostatic latent image may be formed on each of the exposed photosensitive drums 8. When a developer is supplied to each photosensitive drum 8 on which an electrostatic latent image has been formed, the outer peripheral surface of each photosensitive drum 8 may carry a developer image corresponding to the relevant electrostatic latent image.

A belt 13 may be an endless band-like belt that may constitute a transport unit that may transport a sheet from one end side to the other end side of the belt 13 in the arrangement direction. Transfer bodies 14 may be disposed at positions facing the photosensitive drums 8 with the belt 13 in between. A transfer voltage may be applied to each transfer body 14. Accordingly, the developer image carried on each of the photosensitive drums 8 may be transferred onto a sheet in a superimposed manner.

The fixing unit 11 may fix the developer image on the sheet by applying pressure and heat to the developer transferred to the sheet. The sheet on which the image has been formed may be stacked on an ejection tray 3B, which may be provided on the housing 3, with an ejection roller 3A and the like.

A first feeder mechanism 19 and a second feeder mechanism 21 may be provided upstream of the belt 13 in the sheet transporting direction. The first feeder mechanism 19 may feed the sheets stacked on a sheet supply tray 17 sheet by sheet towards the image forming unit 5 side.

The sheet supply tray 17 may be a stacking portion on which a plurality of sheets can be stacked and may be detachably mounted in an apparatus body. The apparatus body may be a pair of main frames (not shown) and the like that are not disassembled or dismounted by the user at times of normal use. The main frames may each be a strength member that are disposed on the two sides of the apparatus body with the image forming unit 5 and the belt 13 therebetween. The image forming unit 5 and the like may be mounted in the pair of main frames.

Figure 2:
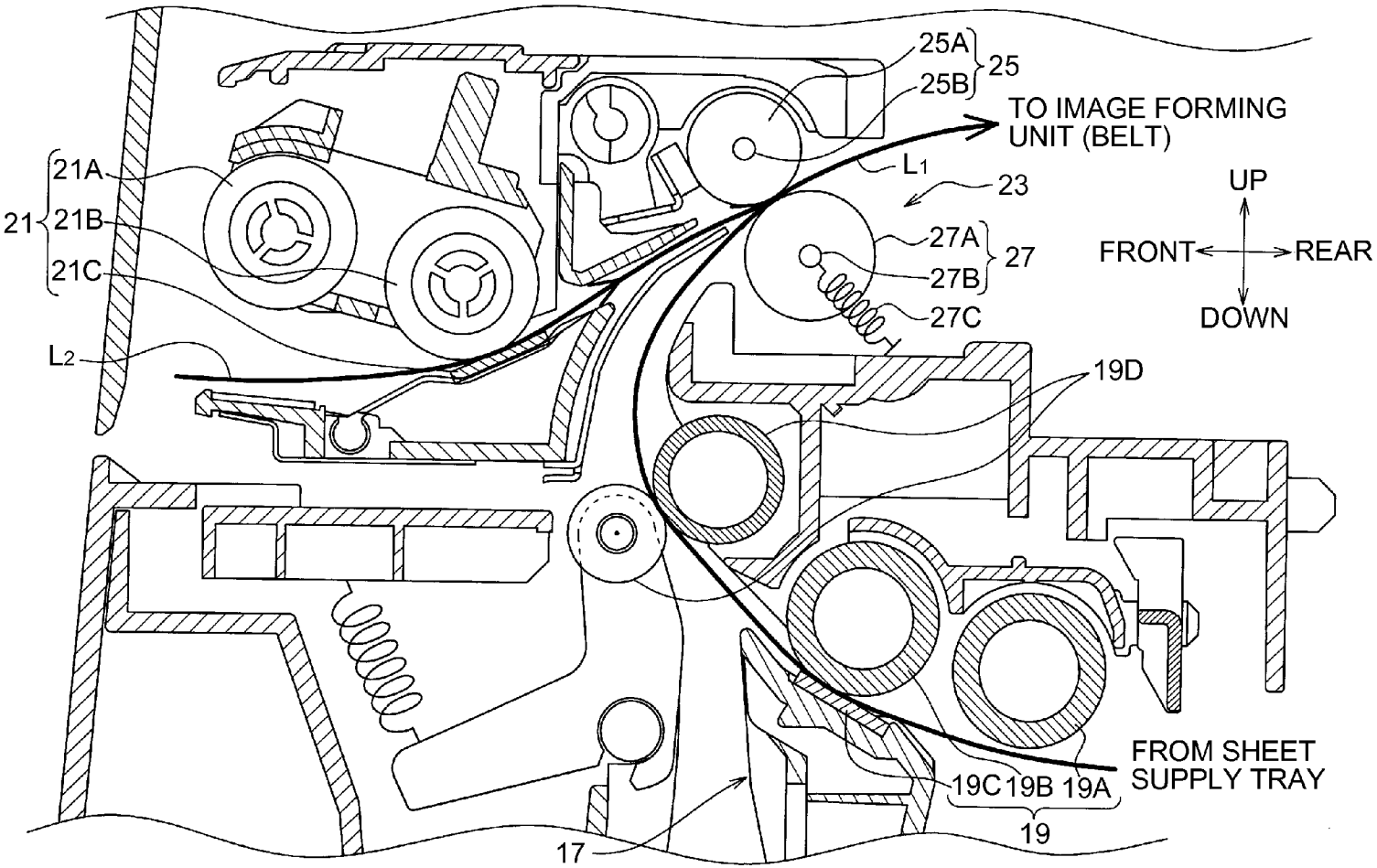
FIG. 2 is an enlarged view of a first feeder mechanism and a second feeder mechanism in the first illustrative embodiment according to one or more aspects of the disclosure.

As illustrated in FIG. 2, the first feeder mechanism 19 may include a pickup roller 19A, a separation roller 19B, a separation pad 19C, and the like. The pickup roller 19A may come into contact with the sheet stacked on the sheet supply tray 17 and send out the sheet towards the separation roller 19B side.

The separation roller 19B may apply transporting force to the sheet by rotating while in contact with the sheet. The separation pad 19C may be disposed at a position opposing the separation roller 19B and may be a frictional resistance body that gives frictional resistance countering the transporting force. Accordingly, when a plurality of sheets are sent out through the pickup roller 19A, the sheets may be separated sheet by sheet and may be transported to the image forming unit 5 side.

The second feeder mechanism 21 may send, sheet by sheet, the sheets that are stacked on a multipurpose sheet supply tray (not shown) towards the image forming unit 5. The multipurpose sheet supply tray may be a stacking portion on which a plurality of sheets can be stacked and may be provided in the housing 3 and in a cover 3C (see FIG. 1) provided on the front side of the image forming unit 5.

The second feeder mechanism 21 may have a similar configuration as that of the first feeder mechanism 19 and may include a pickup roller 21A, a separation roller 21B, and a separation pad 21C, and the like. The pickup roller 21A may come into contact with the sheet stacked on the multipurpose sheet supply tray and send out the sheet towards the separation roller 21B.

The separation roller 21B may apply transporting force to the sheet by rotating while in contact with the sheet. The separation pad 21C may be disposed at a position opposing the separation roller 21B and may be a frictional resistance body that gives frictional resistance countering the transporting force. Accordingly, when a plurality of sheets are sent out through the pickup roller 21A, the sheets may be separated sheet by sheet and be transported to the image forming unit 5 side.

As illustrated in FIG. 2, a sheet transporting device 23 may be provided upstream of the belt 13 in the sheet transport direction. The sheet transporting device 23 may transport the sheet sent from the first feeder mechanism 19 or the second feeder mechanism 21 to the image forming unit 5.

The sheet transporting device 23 may include a first transport roller 25, a second transport roller 27, and the like that rotate while in contact with the sheet. The first transport roller 25 and the second transport roller 27 may be provided downstream of the separation rollers 19B and 21B in a transport path L1.

The first transport roller 25 may include a first roller portion 25A that comes in contact with the sheet, and a first shaft portion 25B that holds the first roller portion 25A. An outer peripheral surface of the first roller portion 25A, in other words, the portion that comes in contact with the sheet, may be constituted by an insulating material such as fluorine. The first shaft portion 25B may extend entirely across the transport path L1 in the width direction and the two ends of the first shaft portion 25B in the longitudinal direction may be fixed with respect to the main frames.

The second transport roller 27 may include a second roller portion 27A that comes in contact with the sheet, and a second shaft portion 27B that holds the second roller portion 27A. Furthermore, the second transport roller 27 may be disposed at a position opposing the first transport roller 25 and may rotate while working together with the first transport roller 25 to nip the transported sheet.

An outer peripheral surface of the second roller portion 27A, in other words, the portion that comes in contact with the sheet, may be constituted by a material, such as rubber, that has a coefficient of friction that is higher than that of the first roller portion 25A. The second shaft portion 27B may extend entirely across the transport path L1 in the width direction and may be directly or indirectly installed in the main frames in a displaceable manner in a direction moving away and moving towards the first transport roller 25.

A pair of pressing members 27C that press the two ends sides of the second transport roller 27 in the shaft direction towards the first transport roller 25 side may be provided on the two ends side of the second shaft portion 27B in the longitudinal direction. The pressing members 27C may each be constituted by an elastic member such as a spring.

Driving force may be given to the second transport roller 27 and the first transport roller 25. Furthermore, the first transport roller 25 and the second transport roller 27 may exert the following registration function by rotating and stopping in an interlocking manner with respect to each other.

In other words, the first transport roller 25 and the second transport roller 27 may stop rotating and temporarily stop the transportation of the transported sheet and, then, start rotating and transport the sheet. Accordingly, the second transport roller 27 may also be referred to as a registration roller. The first transport roller 25 may also be referred to as a registration pinch roller.

In other words, the first transport roller 25 and the second transport roller 27 may temporarily stop the transportation of the sheet by coming in contact with the sheet, which has been sent from the first feeder mechanism 19 or the second feeder mechanism 21, in an unrotated state.

Subsequently, the transportation of the sheet may be resumed by resuming the rotation of the first transport roller 25 and the second transport roller 27. With the above, after the position of the sheet is corrected such that the front end thereof orthogonally intersects the transport direction, the sheet may thrust towards the image forming unit 5 at a predetermined timing.

Figure 3:
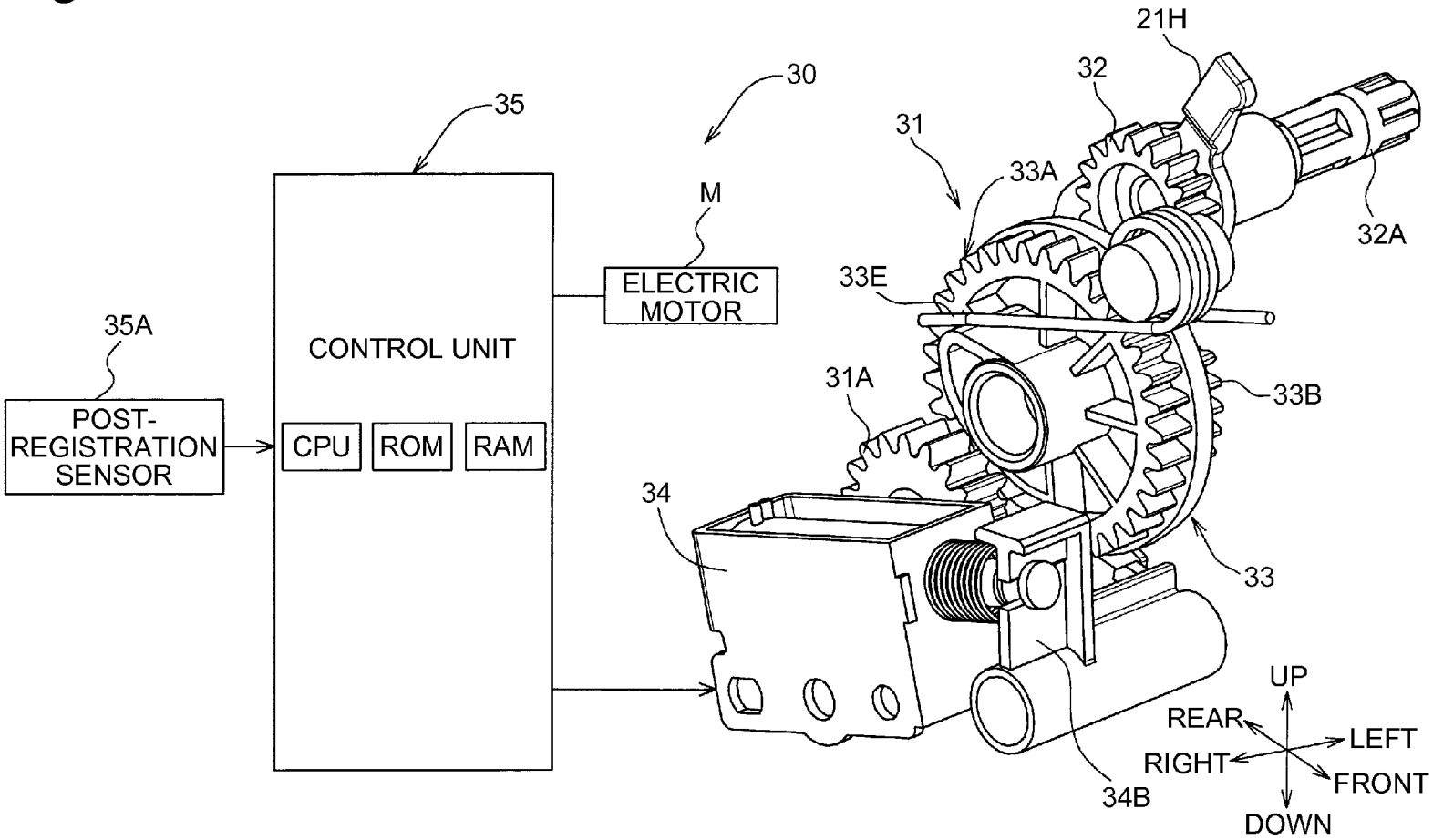
FIG. 3 is a diagram illustrating an outline of a drive controller in the first illustrative embodiment according to one or more aspects of the disclosure.

Note that in the present embodiment, the rotation and stop control of the first transport roller 25 and the second transport roller 27 may be performed by controlling an interrupter (not shown) rather than controlling an electric motor M (see FIG. 3).

The electric motor M may also give driving force to the other rollers such as the pickup roller 19A. The electric motor M may be continuously rotated irrespective of whether the first transport roller 25 and the second transport roller 27 are rotating or at a stop. The interrupter described above may be an electromagnetic clutch or the like that intermittently transmits the driving force generated in the electric motor M to the first transport roller 25 and the second transport roller 27.

Note that, as illustrated in FIG. 2, no intermediate transport roller or the like may be provided downstream of the separation roller 21B in a transport direction L2 of the sheet sent out from the multipurpose sheet supply tray such that the first transport roller 25 is disposed directly after the separation roller 21B.

Furthermore, the horizontal component of the transport path L1 from the separation roller 21B to the belt 13 (image forming unit 5) through the first transport roller 25 may be oriented in the same direction throughout the transport path L1. In other words, the sheet sent out from the multipurpose sheet supply tray to the image forming unit 5 may be transported in a substantially horizontal direction reaching the belt 13 without the direction of transport of the sheet turning 90 degrees or more.

Note that the transport direction of the sheet that has been sent from the separation roller 19B towards the first transport roller 25 may be turned substantially 180 degrees. Furthermore, a pair of intermediate transport rollers 19D may be provided midway of the path from the separation roller 19B to the first transport roller 25.

A drive controller 30 illustrated in FIG. 3 may control the operation of the second feeder mechanism 21 in either of the control modes, namely, a first control mode and a second control mode described later. The drive controller 30 may include a drive mechanism 31 and a control unit 35. The drive mechanism 31 may receive driving force from the electric motor M described above and drive the pickup roller 21A and the separation roller 21B.

The control unit 35 may control the transmission and cutoff of the torque to the pickup roller 21A and the separation roller 21B by controlling the drive mechanism 31. Note that the control unit 35 may be constituted by computers, such as a CPU, a ROM, and a RAM. A program for performing the first control mode and the second control mode, and a cutoff time Ts described later may be stored in a nonvolatile memory unit such as a ROM. The ROM, RAM, and other computer storage devices of control unit 35 represent examples of computer-readable media. Such computer-readable media can, in embodiments, include non-transitory computer-readable media, e.g., tangible media devices.

A post-registration sensor 35A may detect whether a sheet exists in the transport path L1 immediately after the first transport roller 25. Furthermore, when a sheet does exist immediately after the first transport roller 25, the post-registration sensor 35A may output an ON signal towards the control unit 35. When a sheet does not exist immediately after the first transport roller 25, the post-registration sensor 35A may output an OFF signal towards the control unit 35.

3.2 Outline of Drive Control

The drive controller 30 may execute the first control mode when the dimension of the transported sheet in the width direction is smaller than a predetermined dimension (hereinafter, referred to as a lower limit width Wc) and may execute the second control mode when the dimension of the transported sheet in the width direction is equivalent to or larger than the lower limit width Wc.

The lower limit width Wc may be a dimension that is determined on the basis of a contact pressure (hereinafter, also referred to as a nip pressure) in the middle portion in the longitudinal direction between the first transport roller 25 and the second transport roller 27. Incidentally, the lower limit width Wc according to the present embodiment is the same as the dimension of a short side of an A4-sized sheet.

The determination of whether the dimension of the transported sheet in the width direction is smaller than the lower limit width Wc may be determined by the drive controller 30 (the control unit 35) when an image forming (printing) command is issued to the image forming apparatus 1 on the basis of the sheet size set by the user.

In other words, for example, when the user issues a command that an image is to be formed on an A4-sized sheet, the control unit 35 may determine that the dimension of the transported sheet in the width direction is equivalent to or larger than the lower limit width Wc. For example, when the user issues a command that an image is to be formed on an A5-sized sheet, the control unit 35 may determine that the dimension of the transported sheet in the width direction is smaller than the lower limit width Wc.

In the first control mode, torque may be transmitted to the separation roller 21B when a leading edge of the sheet in the transport direction, the sheet being transported in the transport path L1, reaches the first transport roller 25 and when the leading edge of the sheet in the transport direction reaches the belt 13.

Then, transmission of torque to the separation roller 21B may be cut off when a predetermined time (hereinafter, referred to as cutoff time Ts) has passed from when the leading edge of the sheet in the transport direction has reached the belt 13. The cutoff time Ts may be less than the time needed for the leading edge of the sheet in the transport direction, the sheet being transported in the transport path L1, that has reached the belt 13 to reach the image forming unit 5.

The expression "the leading edge of the sheet in the transport direction reaching the image forming unit 5" refers to, in the present embodiment, the leading edge reaching, among the plurality of photosensitive drums 8, the photosensitive drum 8 that is the closest to the first transport roller 25 (the photosensitive drum 8 on the left side in FIG. 1).

In the second control mode, torque may be transmitted to the separation roller 21B when the leading edge of the sheet in the transport direction, the sheet being transported in the transport path L1, reaches the first transport roller 25, and the transmission of torque to the separation roller 21B may be cut off before the leading edge of the sheet in the transport direction reaches the belt 13.

As illustrated in FIG. 3, the drive mechanism 31 may include an input gear 31A, an output gear 32, a transmission gear 33, a solenoid 34, and the like. The input gear 31A may rotate by input of torque output from the electric motor M. Furthermore, the input gear 31A may rotate and stop while being interlocked with the rotation and stoppage of the electric motor M.

Note that the electric motor M may rotate continuously from the time an image formation start command is issued until the completion of the image formation. Accordingly, the input gear 31A may also rotate continuously from the time the image formation start command is issued until the completion of the image formation.

Figure 4:
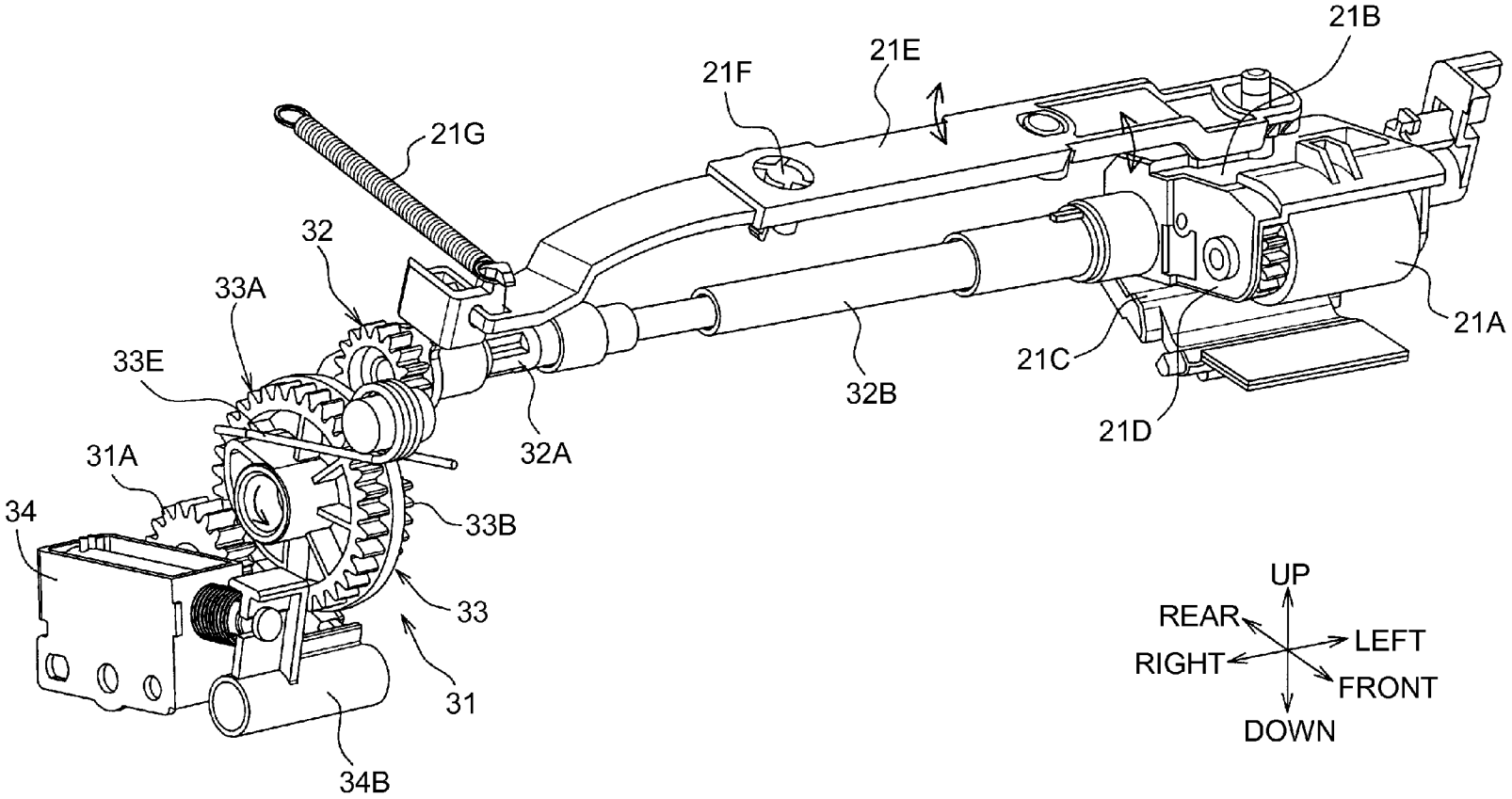
FIG. 4 is a diagram illustrating an outline of a drive mechanism in the first illustrative embodiment according to one or more aspects of the disclosure.

The output gear 32 may output torque to the separation roller 21B side. As illustrated in FIG. 4, a rotating shaft 32A of the output gear 32 may be coupled to a driving shaft 32B that may transmit driving force to the separation roller 21B.

Note that the pickup roller 21A may rotate by receiving torque from the separation roller 21B through a transmission unit including a gear. In other words, the pickup roller 21A may rotate and stop while being interlocked with the rotation and stoppage of the separation roller 21B.

The pickup roller 21A may be installed in a holder 21D in a rotatable manner. The holder 21D may swing the entire pickup roller 21A with a central axis of rotation of the separation roller 21B as its swing axis line.

Furthermore, when sending out the sheet stacked on the multipurpose sheet supply tray towards the separation roller 21B side, the pickup roller 21A may be swung and displaced downwards from a position illustrated in FIG. 4 (hereinafter, referred to as a standby position) so as to rotate while in contact with the sheet. After a predetermined time, the pickup roller 21A may be returned to the standby position from the position allowing the pickup roller 21A to be in contact with the sheet (hereinafter, referred to as a feed position), and the rotation thereof may be stopped subsequently.

A lift arm 21E is a member that may swing and displace the holder 21D, that is, the pickup roller 21A, between the standby position and the feed position. The lift arm 21E may extend from the input gear 31A side towards the separation roller 21B side and a longitudinal-direction intermediate portion 21F may be supported by the lift arm 21E in a swingable manner.

Hereinafter, a position of the lift arm 21E when the pickup roller 21A is in the standby position is also referred to as the standby position. A position of the lift arm 21E when the pickup roller 21A is in the feed position is also referred to as the feed position.

A return spring 21G may apply an elastic force to the lift arm 21E that swings the lift arm 21E from the standby position towards the feed position. In other words, the return spring 21G may exert force that maintains the lift arm 21E and the pickup roller 21A in the feed position.

Figure 5B:
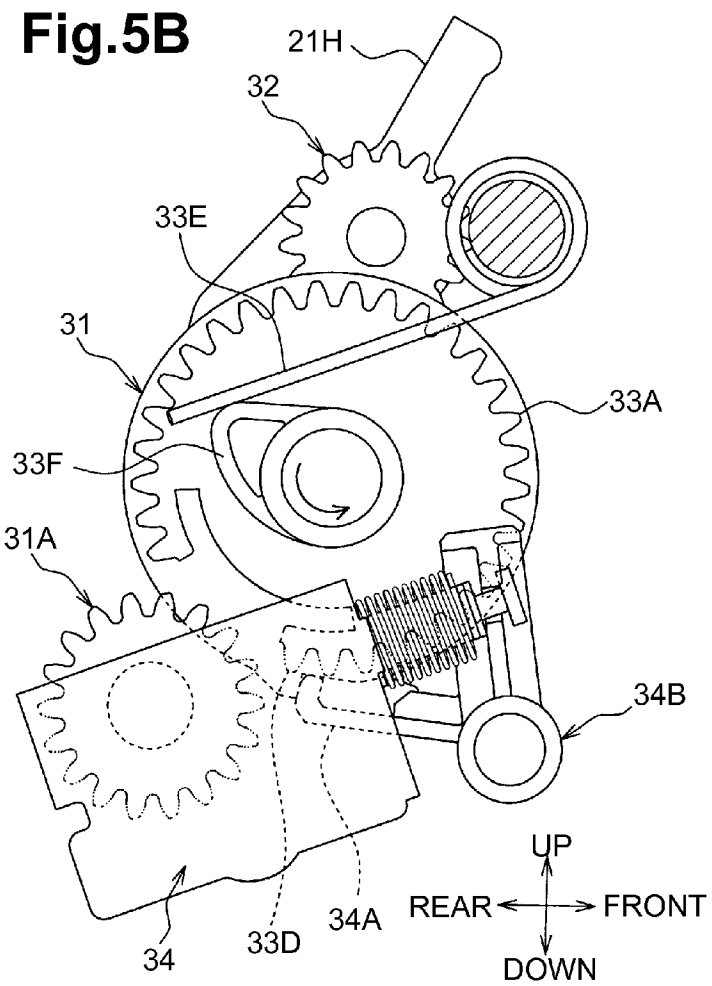
FIGS. 5A and 5B are diagrams illustrating the drive mechanism in the first illustrative embodiment according to one or more aspects of the disclosure.
Figure 5A:
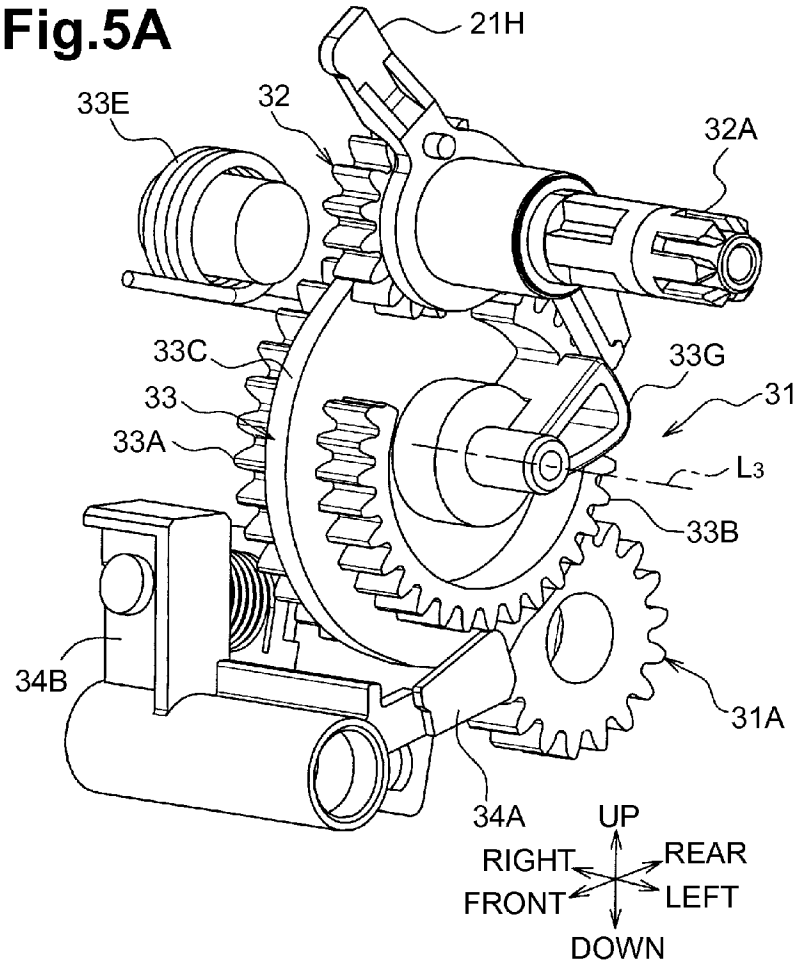

As illustrated in FIG. 5A, the transmission gear 33 may have, with a disc-like body portion 33C in between, a first gear 33A on one side and a second gear 33B on the other side. The first gear 33A and the second gear 33B may have a common axis of rotation L3.

The first gear 33A may mesh with the input gear 31A. The second gear 33B may mesh with the output gear 32. Accordingly, when the transmission gear 33 meshes with the input gear 31A and the output gear 32, in other words, when the first gear 33A meshes with the input gear 31A and when the second gear 33B meshes with the output gear 32, torque may be transmitted from the input gear 31A to the output gear 32.

The second gear 33B may not be provided with teeth around the whole circumference of the axis of rotation L3 and may be a gear in which a portion is not provided with teeth. As illustrated in FIG. 5B, similar to the second gear 33B, the first gear 33A may not be provided with teeth around the whole circumference of the axis of rotation L3 and may be a gear in which a portion is not provided with teeth.

Accordingly, depending on the position of the transmission gear 33, there may be a case in which the transmission gear 33 meshes with the input gear 31A and the output gear 32 (hereinafter, referred to as a transmission state) and a case in which the transmission gear 33 does not mesh with the input gear 31A and the output gear 32 (hereinafter, referred to as a cutoff state). As described above, since the transmission gear 33 may have a function of selectively switching the state of the drive mechanism 31, the transmission gear 33 is also referred to as a sector gear.

Furthermore, when the drive mechanism 31 is in the transmission state, torque may be transmitted to the separation roller 21B. When the drive mechanism 31 is in the cutoff state, transmission of torque to the separation roller 21B may be cut off. The transmission gear 33 may only rotate in the direction indicated by the arrow, that is, the transmission gear 33 may only rotate in the direction in which the sheet is transported. Hereinafter, rotation of the transmission gear 33 will mean that the transmission gear 33 rotates in the direction indicated by the arrow.

An engagement portion 33D that may be engaged with a stopper portion 34A may be provided in the body portion 33C of the transmission gear 33. In a state in which the stopper portion 34A and the engagement portion 33D are engaged with each other, the transmission gear 33 may not rotate and the drive mechanism 31 may be in the cutoff state.

The stopper portion 34A may be an arm-shaped member that may be integrally provided with a solenoid lever 34B. The solenoid lever 34B is a member that may be installed in the apparatus body in a swingable manner and may be swung and displaced according to the energized state of the solenoid 34.

Furthermore, when the solenoid 34 is not energized (when off), the stopper portion 34A and the engagement portion 33D may be allowed to engage with each other. When the solenoid 34 is energized (when on), the engagement between the stopper portion 34A and the engagement portion 33D may be released and the output gear 32 may be allowed to rotate.

A drive spring 33E may press a first cam portion 33F provided in the body portion 33C. Furthermore, the direction of elastic force of the drive spring 33E acting on the first cam portion 33F may be the direction in which the transmission gear 33 is rotated. Accordingly, when the solenoid 34 is energized, since the engagement between the stopper portion 34A and the engagement portion 33D are released, the transmission gear 33 may be rotated by the elastic force of the drive spring 33E.

As illustrated in FIG. 5A, by being pressed by a second cam portion 33G, a lift lever 21H may apply force to the lift arm 21E in a direction countering the elastic force of the return spring 21G, in other words, the lift lever 21H may apply force to the lift arm 21E that acts in the direction that swings the lift arm 21E from the feed position to the standby position. The lift lever 21H may be supported by the rotating shaft 32A in a rotatable manner. The second cam portion 33G may be provided in the transmission gear 33.

Initial State (First State)

Figure 6B:
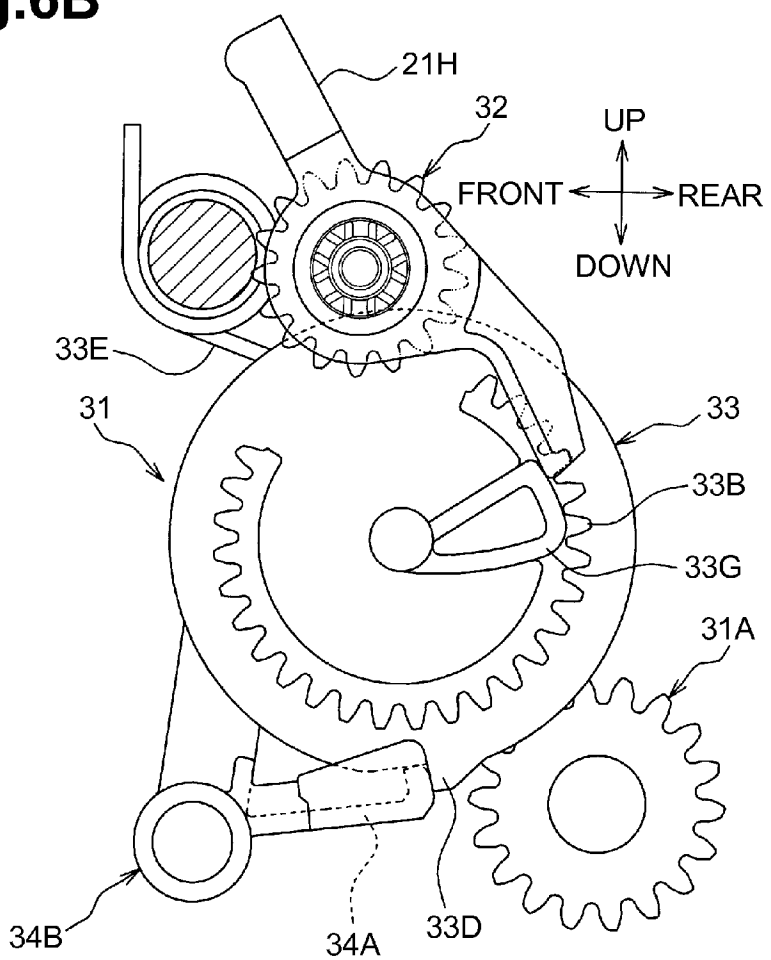
FIGS. 6A and 6B are diagrams illustrating operations of the drive mechanism in the first illustrative embodiment according to one or more aspects of the disclosure.
Figure 6A:
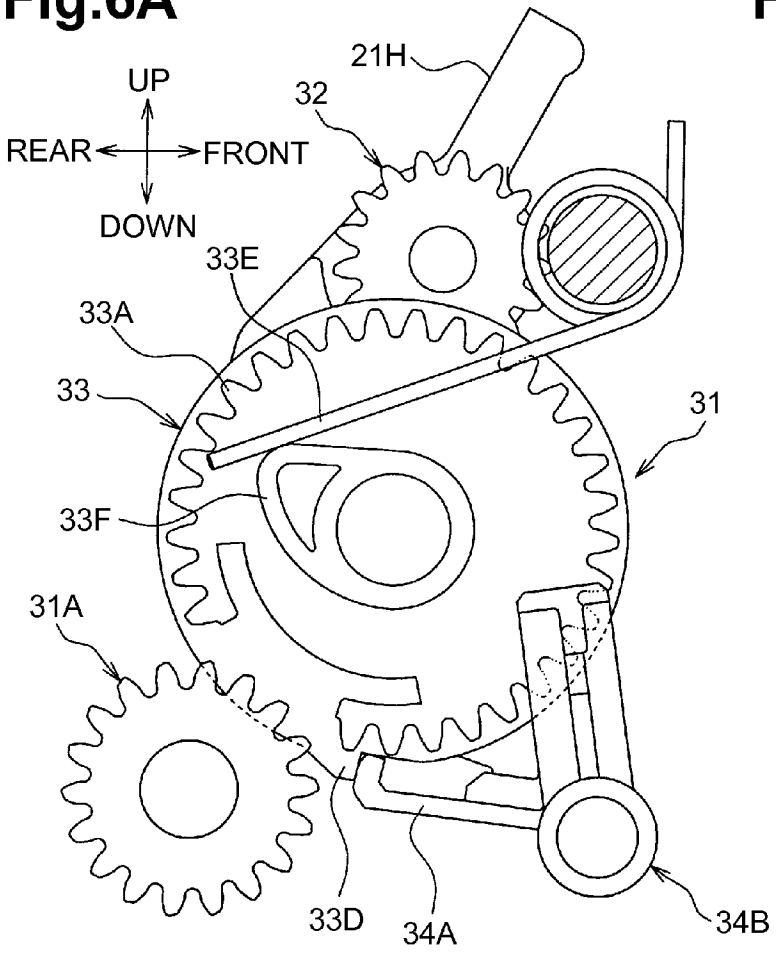

As illustrated in FIGS. 6A and 6B, in an initial state, the solenoid 34 may be non-energized, the stopper portion 34A and the engagement portion 33D may be engaged with each other, and the drive mechanism 31 may be in the cutoff state. The lift arm 21E may be pressed by the lift lever 21H and may be in the standby position. Note that in FIGS. 6A and 6B, the solenoid 34 is omitted.

Second State

Figure 7B:
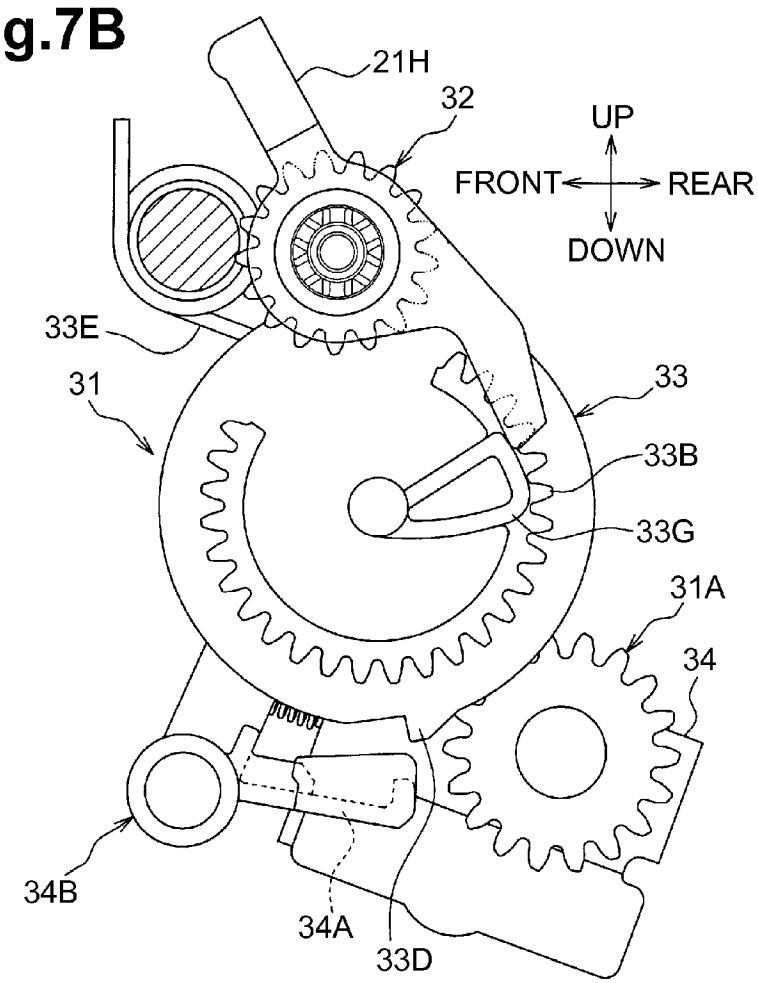
FIGS. 7A and 7B are diagrams illustrating operations of the drive mechanism in the first illustrative embodiment according to one or more aspects of the disclosure.
Figure 7A:
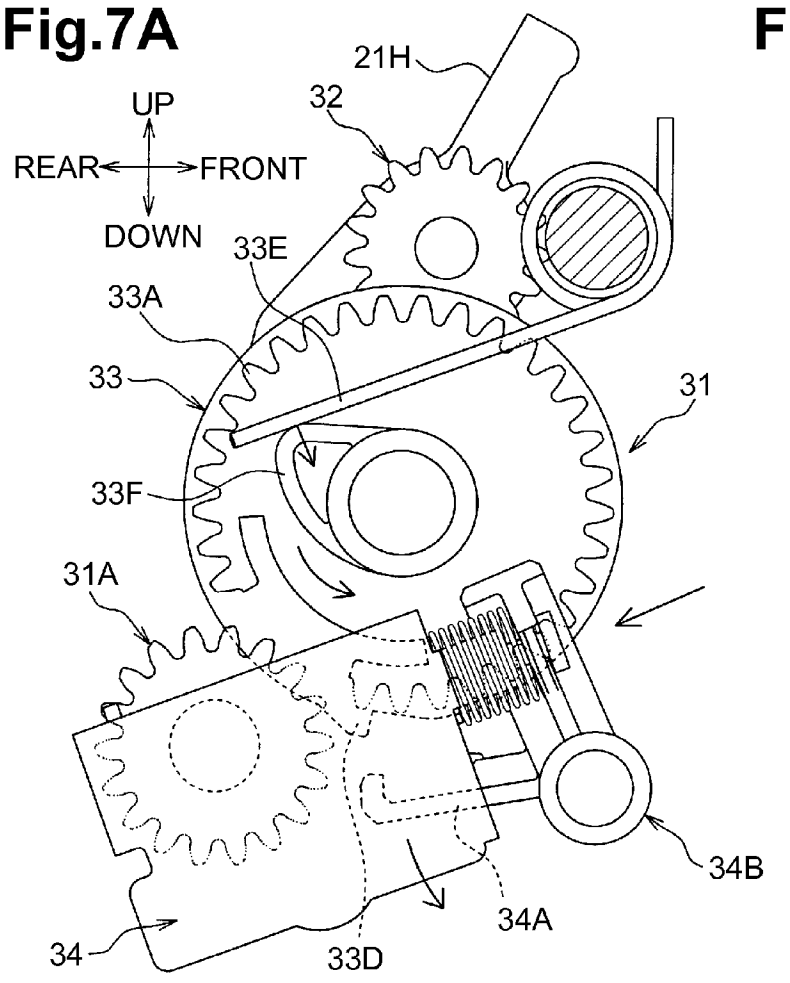

When the solenoid 34 is energized for a predetermined time in the initial state, as illustrated in FIGS. 7A and 7B, the engagement between the stopper portion 34A and the engagement portion 33D may be released. Accordingly, the transmission gear 33 may start to rotate by the elastic force of the drive spring 33E. Note that the above-described predetermined time (hereinafter, referred to as energization time) may be a time period that does not allow the released engagement to re-engage, and may specifically be 0.1 seconds.

Third State

Figure 8B:
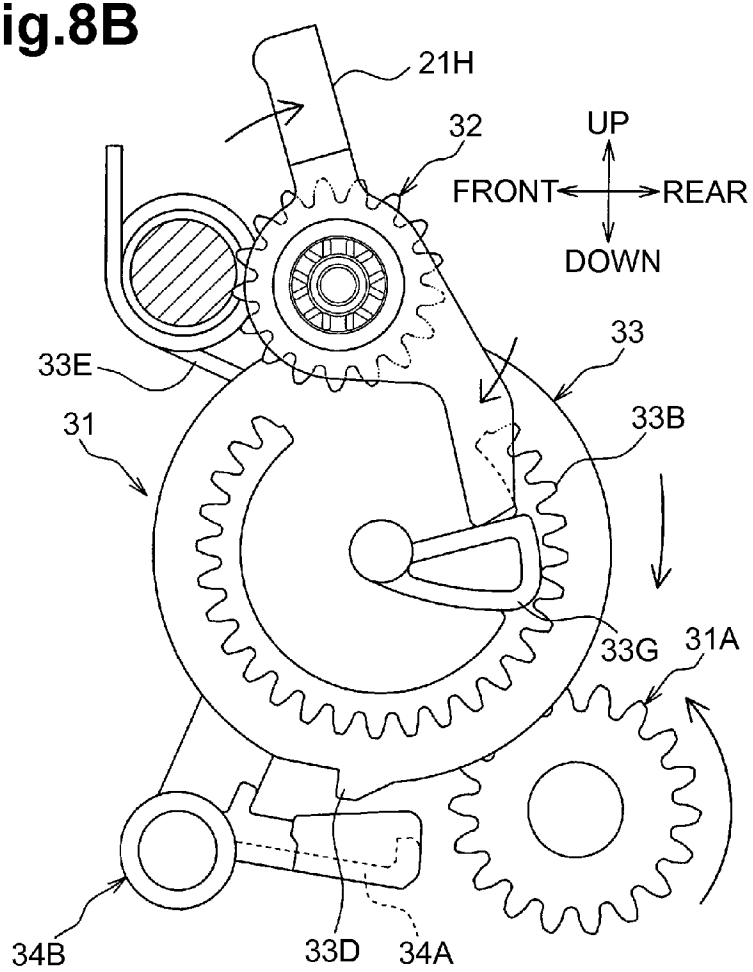
FIGS. 8A and 8B are diagrams illustrating operations of the drive mechanism in the first illustrative embodiment according to one or more aspects of the disclosure.
Figure 8A:
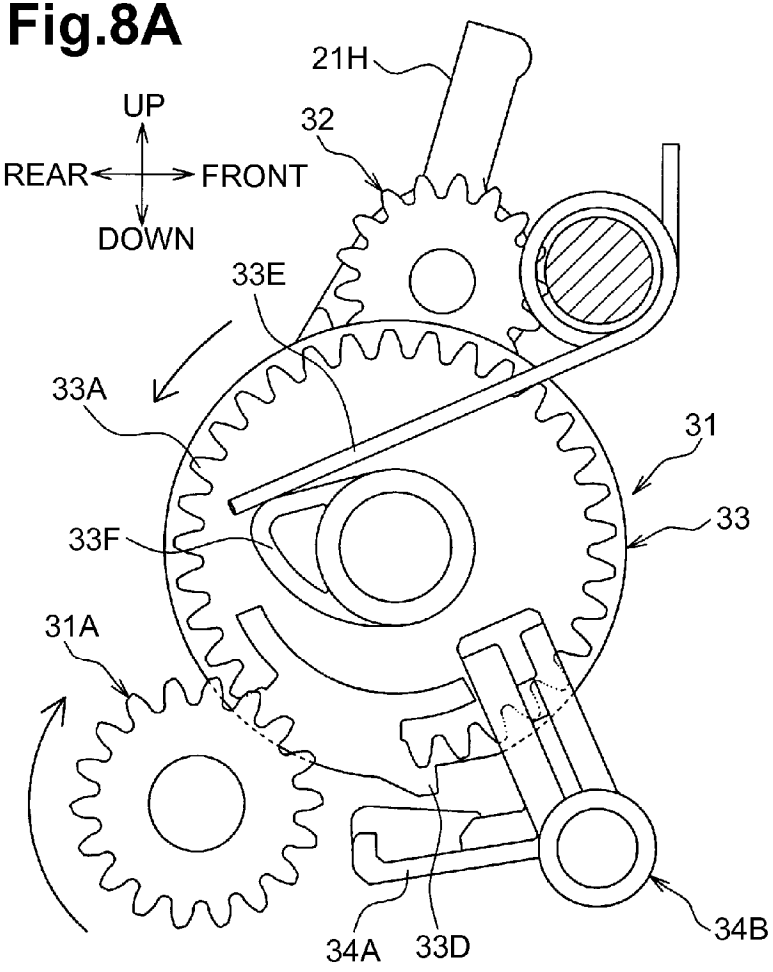

When the rotation of the transmission gear 33 further progresses from the second state, as illustrated in FIG. 8A, the input gear 31A and the first gear 33A may be meshed with each other, and as illustrated in FIG. 8B, the lift lever 21H may be disengaged from the second cam portion 33G; accordingly, the lift arm 21E may be swung from the standby position to the feed position. Note that in FIGS. 8A and 8B, the solenoid 34 is omitted.

Fourth State

Figure 9B:
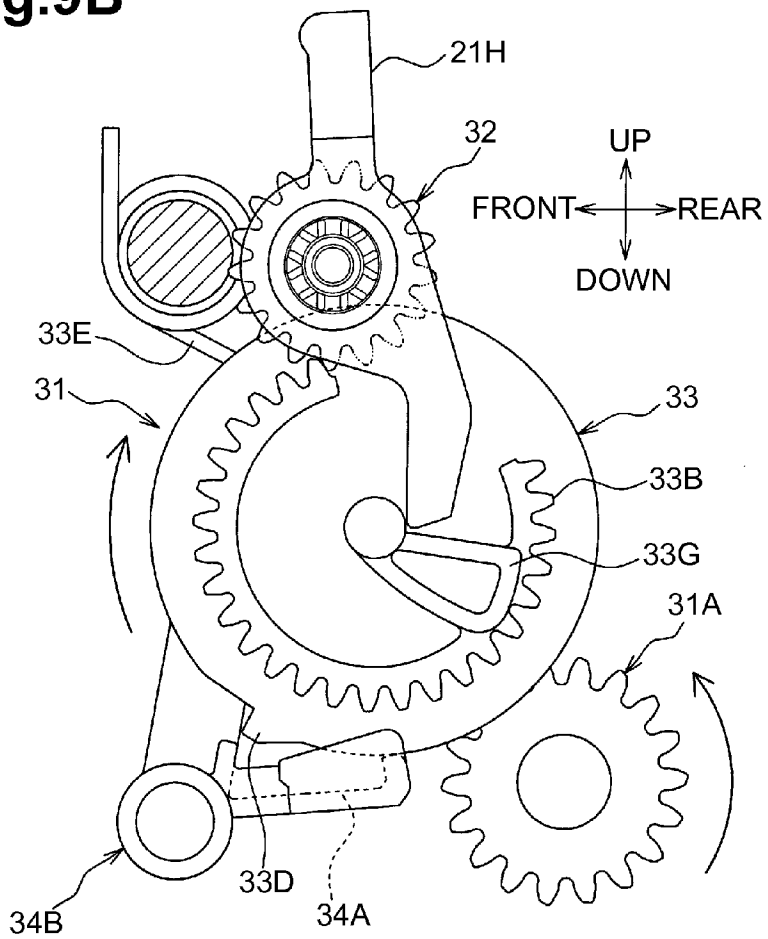
FIGS. 9A and 9B are diagrams illustrating operations of the drive mechanism in the first illustrative embodiment according to one or more aspects of the disclosure.
Figure 9A:
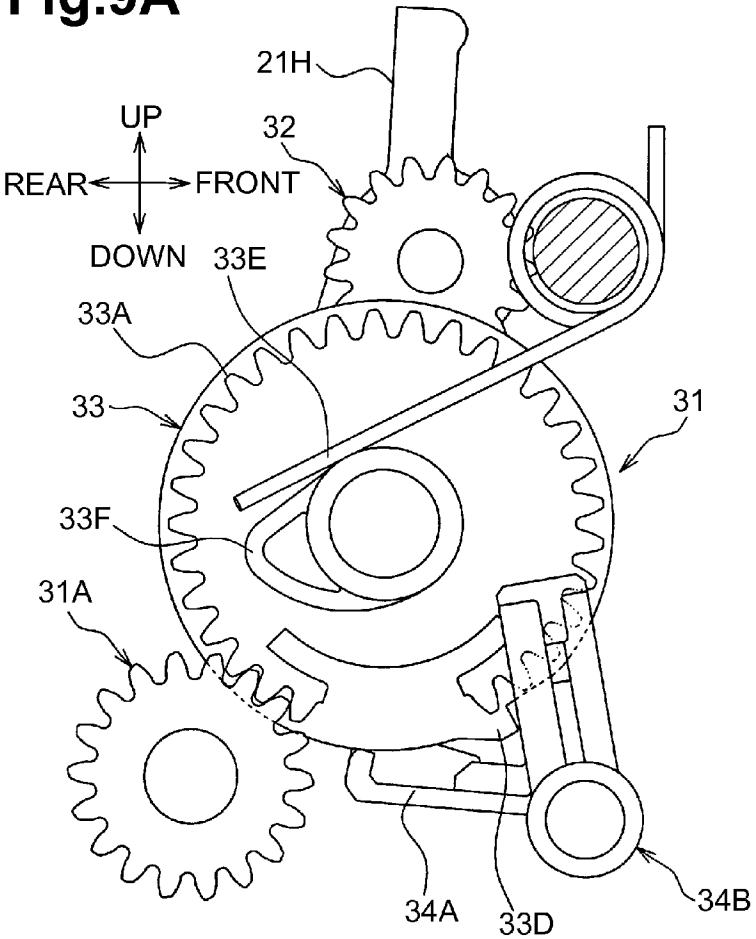

As illustrated in FIG. 9A, the transmission gear 33 receiving torque from the input gear 31A may further rotate from the second state. Accordingly, as illustrated in FIG. 9B, the output gear 32 may mesh with the second gear 33B and the drive mechanism 31 may be in the transmission state. Note that in FIGS. 9A and 9B, the solenoid 34 is omitted.

Figure 10B:
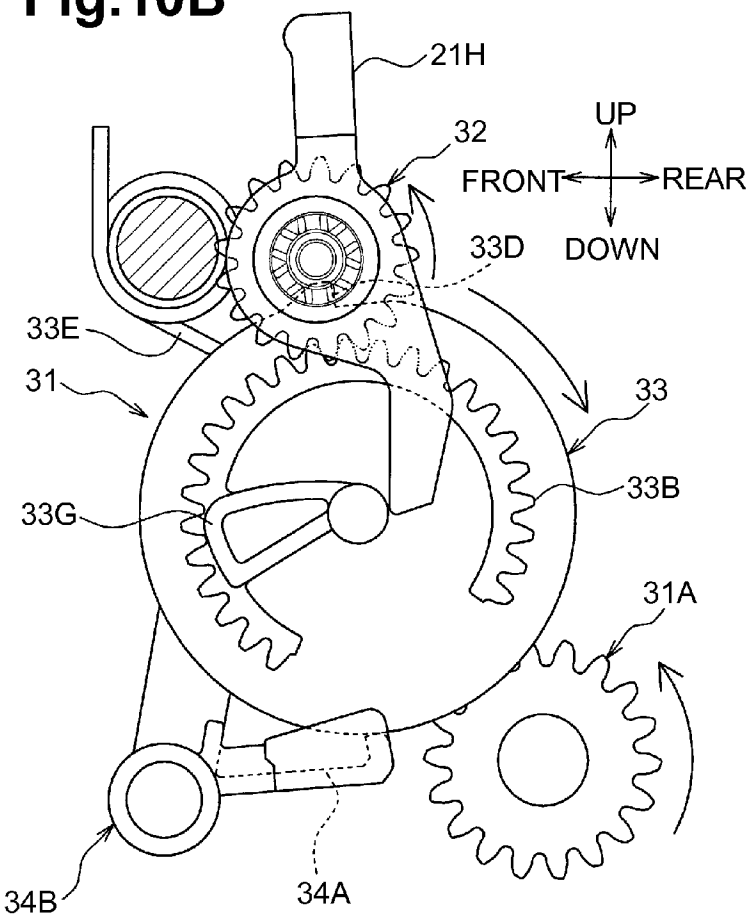
FIGS. 10A and 10B are diagrams illustrating operations of the drive mechanism in the first illustrative embodiment according to one or more aspects of the disclosure.
Figure 10A:
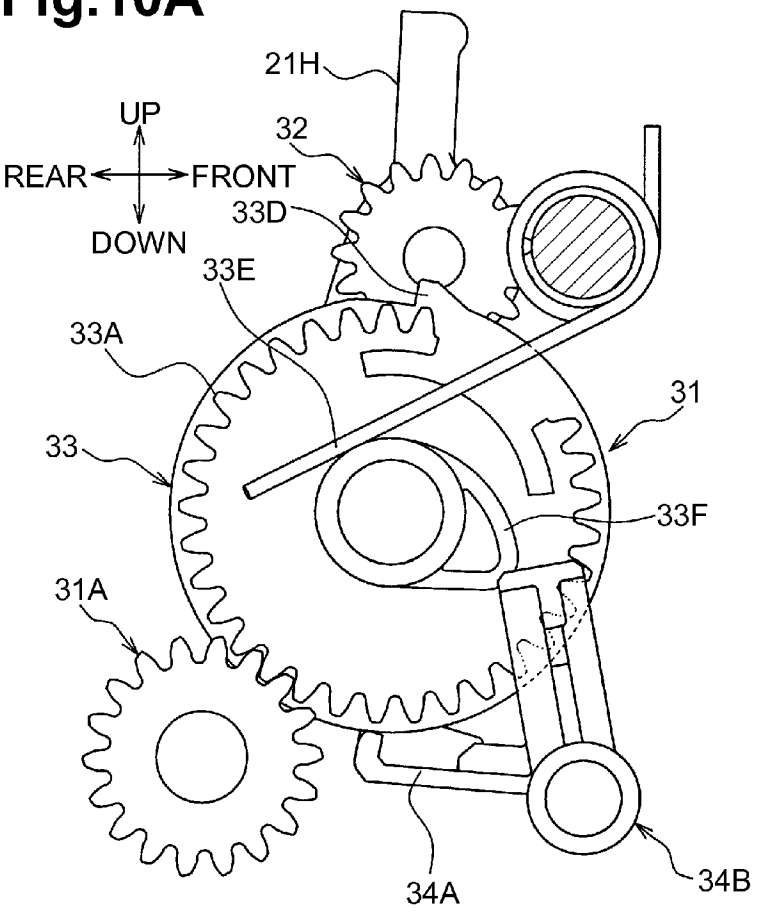

Furthermore, as illustrated in FIGS. 10A and 10B, torque may be transmitted from the input gear 31A to the output gear 32 through the transmission gear 33 such that the pickup roller 21A and the separation roller 21B rotate. Note that in FIGS. 10A and 10B, the solenoid 34 is omitted.

Fifth State

Figure 11B:
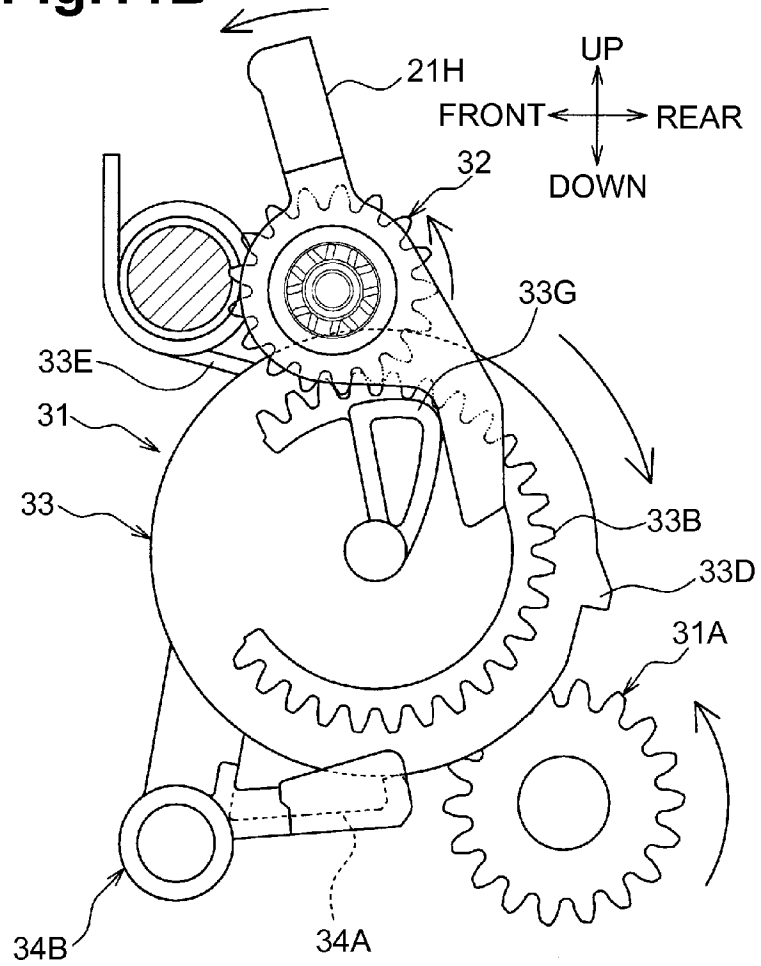
FIGS. 11A and 11B are diagrams illustrating operations of the drive mechanism in the first illustrative embodiment according to one or more aspects of the disclosure.
Figure 11A:
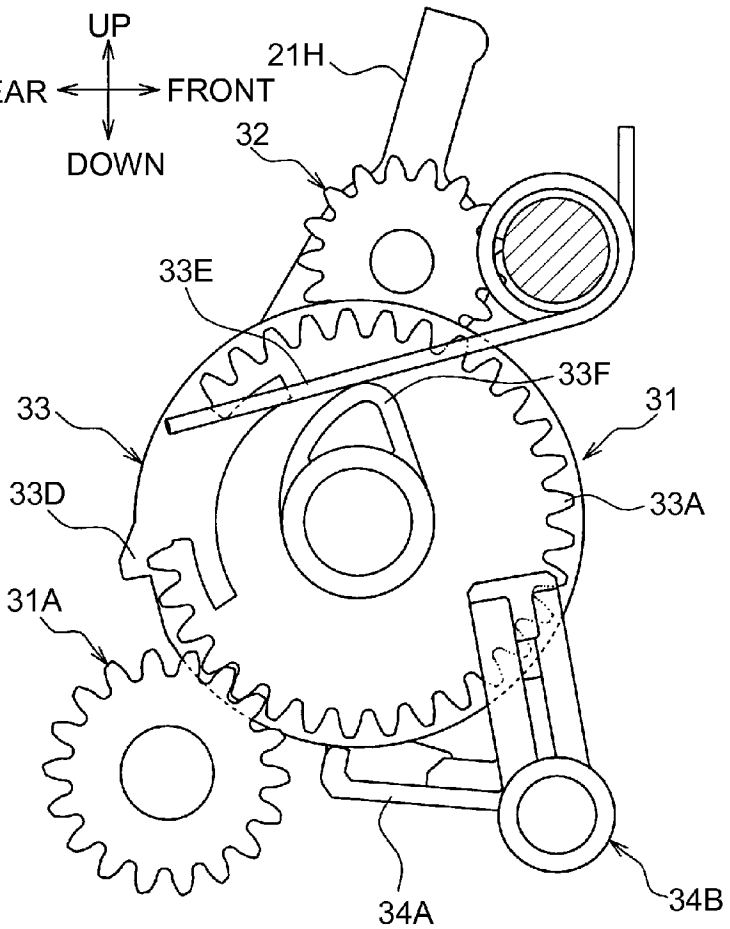

When the transmission gear 33 further rotates from the fourth state, as illustrated in FIG. 11A, the drive spring 33E may start to elastically deform. At the same time, as illustrated in FIG. 11B, the second cam portion 33G may start to press the lift lever 21H and, accordingly, the lift arm 21E may start to swing from the feed position to the standby position. Note that in FIGS. 11A and 11B, the solenoid 34 is omitted.

Sixth State

Figure 12B:
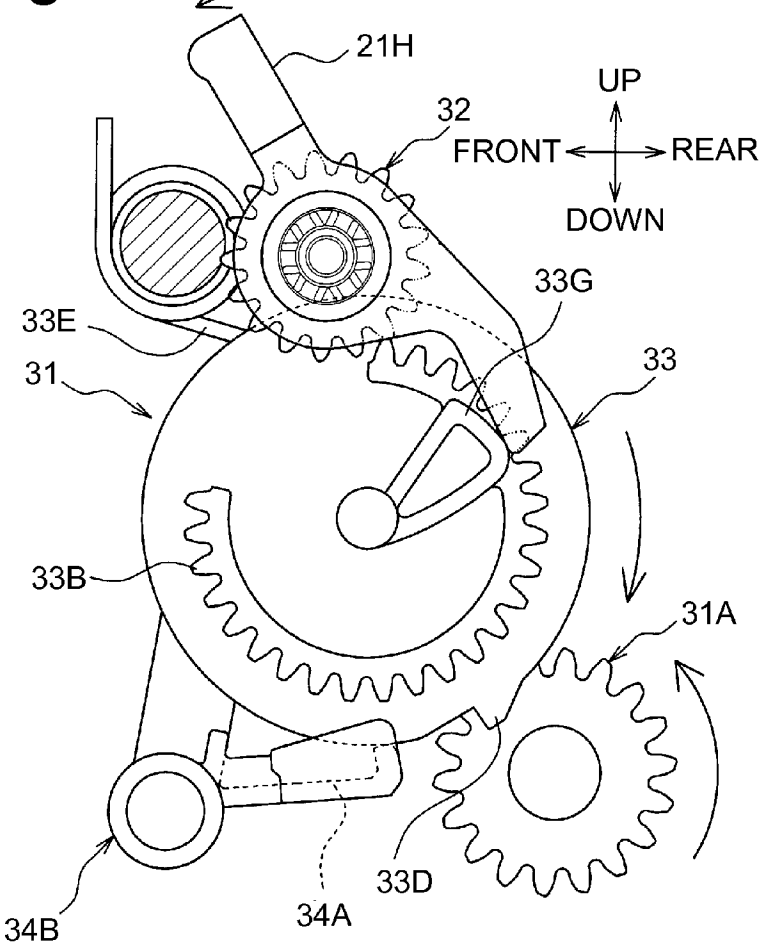
FIGS. 12A and 12B are diagrams illustrating operations of the drive mechanism in the first illustrative embodiment according to one or more aspects of the disclosure.
Figure 12A:
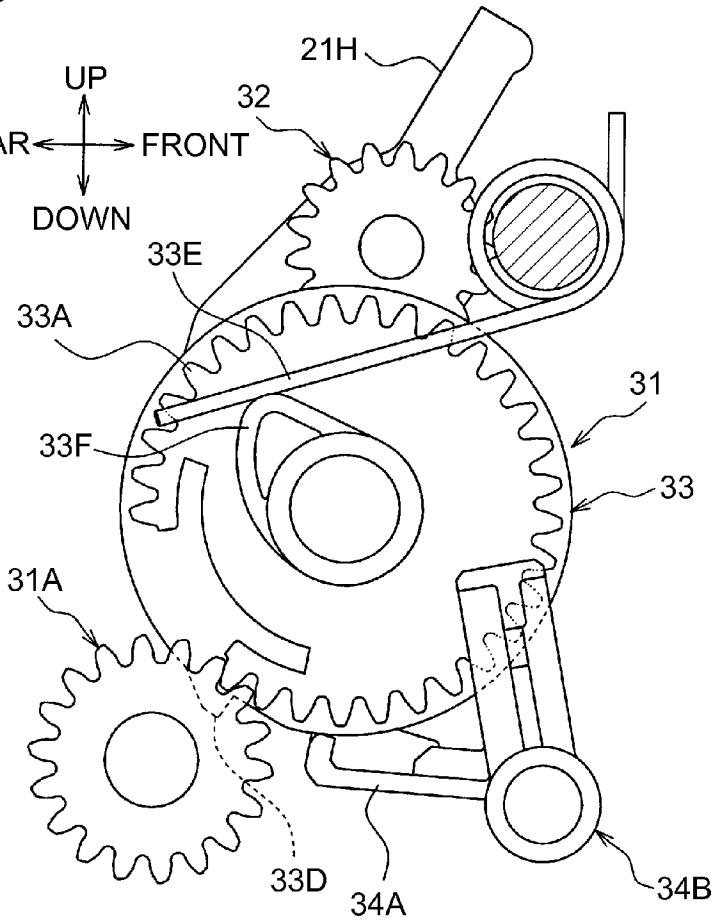

When the transmission gear 33 further rotates from the fifth state, as illustrated in FIG. 12A, the amount of elastic deformation of the drive spring 33E may increase, and as illustrated in FIG. 12B, the engagement between the output gear 32 and the second gear 33B may be released such that the drive mechanism 31 may be in the cutoff state and the lift arm 21E is in the standby state. Note that in FIGS. 12A and 12B, the solenoid 34 is omitted.

Seventh State

Figure 13B:
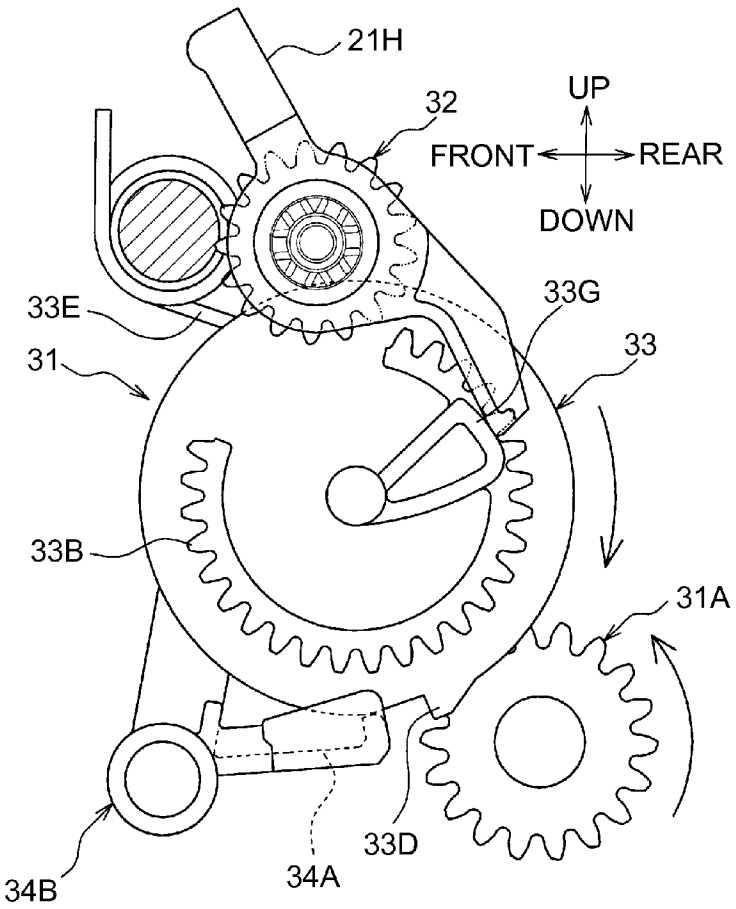
FIGS. 13A and 13B are diagrams illustrating operations of the drive mechanism in the first illustrative embodiment according to one or more aspects of the disclosure.
Figure 13A:
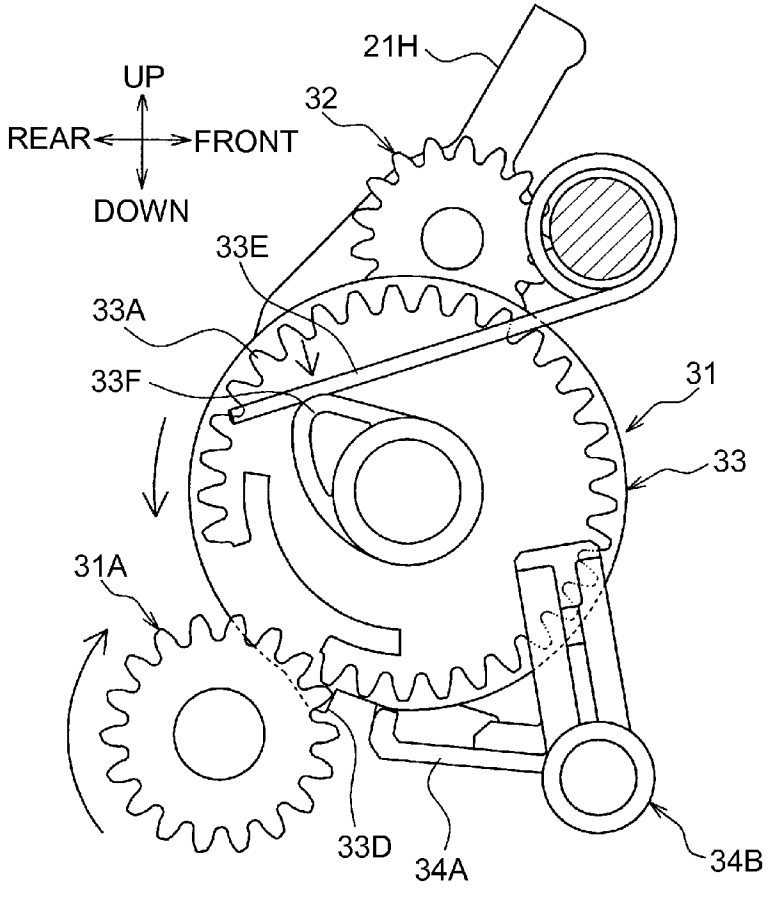

When the transmission gear 33 further rotates from the sixth state, as illustrated in FIG. 13A, the engagement between the input gear 31A and the first gear 33A may be released and the transmission gear 33 may start to rotate by the elastic force of the drive spring 33E.

At the same time, as illustrated in FIG. 13B, the lift lever 21H may be displaced onto the second cam portion 33G and, accordingly, the lift arm 21E may be maintained at the standby position. Note that in FIGS. 13A and 13B, the solenoid 34 is omitted.

Eighth State

While the lift lever 21H is displaced on the second cam portion 33G, the transmission gear 33 may be rotated by the elastic force of the drive spring 33E. Then, when the stopper portion 34A and the engagement portion 33D engage with each other, the rotation of the transmission gear 33 may stop and the state may be returned to the initial state.

Figure 14:
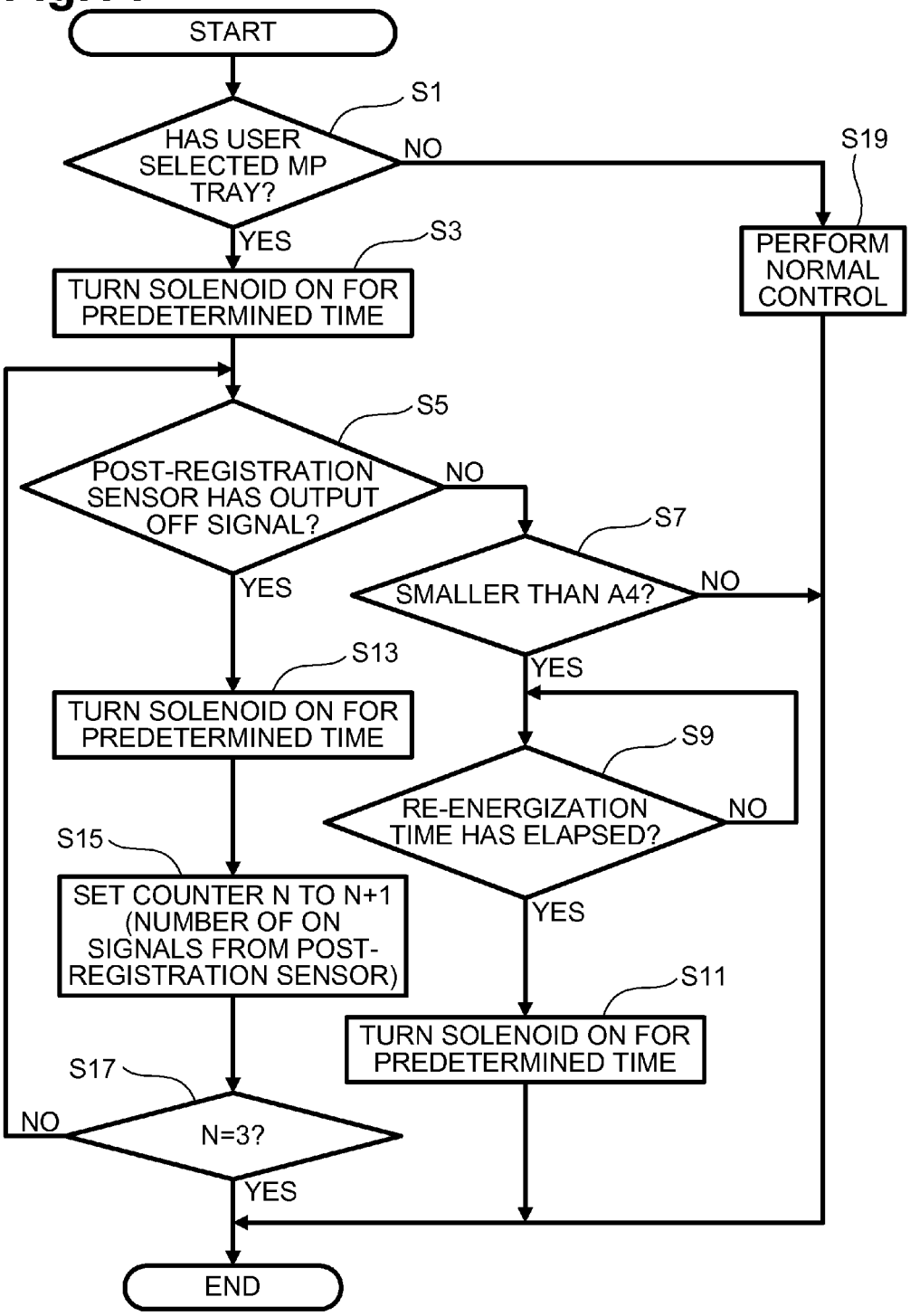
FIG. 14 is a flowchart illustrating an operation of the controller in the first illustrative embodiment according to one or more aspects of the disclosure.

FIG. 14 is a flow chart illustrating an operation performed by the CPU of the control unit 35, in other words, FIG. 14 is a flow chart illustrating an energization control of the solenoid 34. A program for executing the energization control may be stored in the above-described ROM. When the user issues a printing command to the image forming apparatus 1, the present control may be read from the ROM and may be executed by the CPU (the control unit 35).

Note that the present energization control is a control for when printing on a single sheet is performed. Accordingly, when printing is performed on a plurality of sheets, the present energization control is repeated for the number of times corresponding to the number of prints.

Furthermore, when the present control is activated, the CPU of the control unit 35 may determine whether the user has issued a printing command of the sheet stacked on the multipurpose sheet supply tray (S1). The determination may be performed by using information included in the printing command that the user has issued to the image forming apparatus 1.

When determined that a printing command of the sheet stacked on the multipurpose sheet supply tray has been issued (S1: YES), the solenoid 34 may be energized for a period equivalent to the energization time described above (S3). Accordingly, since the drive mechanism 31 is brought to the second state, the transmission gear 33 may start to rotate. Next, determination of whether an OFF signal has been output from the post-registration sensor 35A may be performed (S5).

When determined that an OFF signal has not been output from the post-registration sensor 35A, that is, when determined that an ON signal has been output from the post-registration sensor 35A (S5: NO), determination of whether the size of the sheet stacked on the multipurpose sheet supply tray is smaller than A4 may be performed (S7). The determination may be performed by using the sheet size information included in the printing command that the user has issued to the image forming apparatus 1.

When determined that the size of the sheet stacked on the multipurpose sheet supply tray is smaller than A4 (S7: YES), determination of whether a predetermined time (hereinafter, referred to as a re-energization time) from the end of the energization of the solenoid 34 that has been performed in S3 has elapsed may be performed (S9). When determined that the elapsed time has not reached the re-energization time (S9: NO), S9 may be performed again.

When determined that the elapsed time has reached the re-energization time (S9: YES), the solenoid 34 is energized again for a period equivalent to the energization time described above (S11), and after the transmission gear 33 is in a rotatable state, the present energization control may be ended.

In S7, when determined that the size of the sheet stacked on the multipurpose sheet supply tray is equivalent to or larger than A4 (S7: NO), the present control may be ended without performing energization of the solenoid 34 for the second time.

When determined that an OFF signal has been output from the post-registration sensor 35A (S5: YES), a re-feeding process may be performed assuming that the feeding of the sheet with the pickup roller 21A has failed (S13 to S17).

In other words, when determined that an OFF signal has been output from the post-registration sensor 35A in S5 (S5: YES), the solenoid 34 may be energized for a period equivalent to the above energization time (S13), and then, the counter for counting the number of energization may be incremented by 1 (S15).

Next, determination of whether the value of the counter is equivalent to a predetermined set value (three, in the present embodiment) may be performed (S17). When the value of the counter is not three, in other words, when the value of the counter is two or less (S17: NO), S5 may be performed again.

When determined that the counter value is three (S17: YES), regardless of whether the feeding of the sheet has been achieved successively or not, the counter value may be reset to the initial value (zero) and the present energization control may be ended.

Note that in S1, when determined that a printing command of the sheet stacked on the multipurpose sheet supply tray has not been issued (S1: NO), normal control in which the sheet is fed from the sheet supply tray 17 may be performed (S19).

The re-energization time may be, as described above, a time period that determines the timing of the re-energization of the solenoid 34 after the first energization of the solenoid 34. The re-energization time may be equivalent to or longer than a time period required for the transmission gear 33 to rotate once (hereinafter, referred to as a single rotation time) or may be a time period below the single rotation time (0.3 seconds, for example).

Note that when the re-energization time is equivalent to or longer than the single rotation time, the transmission gear 33 may rotate once and the stopper portion 34A and the engagement portion 33D may be engaged with each other, then, the engagement may be released bringing the transmission gear 33 to a rotatable state.

When the re-energization time is below the single rotation time, then, after the first energization of the solenoid 34, the solenoid 34 may be energized once more before the stopper portion 34A and the engagement portion 33D engage with each other. In other words, when the re-energization time is below the single rotation time, the transmission gear 33 may enter the second rotation continuously without stopping.

Furthermore, regardless of whether the re-energization time is equivalent to or longer than, or below the single rotation time, after the transmission gear 33 has entered the second rotation and when the leading edge of the sheet in the transport direction thrusts towards the belt 13, the stopper portion 34A and the engagement portion 33D may be engaged with each other and the rotation of the transmission gear 33 may be stopped.

In other words, the energization time and the re-energization time may be set at time periods in which (a) the drive mechanism 31 is in the transmission state when the leading edge of the sheet in the transport direction, the sheet transported in the transport path L1, reaches the first transport roller 25 and when the leading edge of the sheet in the transport direction reaches the belt 13 and (b) the drive mechanism 31 is in the cutoff state when the cutoff time Ts has elapsed from after the leading edge of the sheet in the transport direction has reached the belt 13.

In the first control mode according to the present embodiment, transporting force may be given from the separation roller 21B to the sheet when the leading edge of the sheet in the transport direction reaches the first transport roller 25 and when the leading edge of the sheet in the transport direction reaches the belt 13.

Accordingly, occurrence of transport failure can be suppressed with the transporting force given to the sheet from the separation roller 21B even if frictional resistance from the separation pad 21C acts on the sheet when the first transport roller 25 and the second transport roller 27 cannot nip the sheet with a large nip pressure.

Furthermore, transmission of torque to the separation roller 21B may be cut off when the cutoff time Ts has passed from when the leading edge of the sheet in the transport direction has reached the belt 13. Accordingly, early wear of the separation roller 21B may be suppressed since the separation roller 21B is not driven more than required.

The second control mode according to the present embodiment has a feature in that torque may be transmitted to the separation roller 21B when the leading edge of the sheet in the transport direction reaches the first transport roller 25, and the transmission of torque to the separation roller 21B may be cut off before the leading edge of the sheet in the transport direction reaches the belt 13.

Accordingly, in the present embodiment, switching control between a case in which the separation roller 21B is driven in the first control mode and a case in which the separation roller 21B is driven in the second control mode may be performed as required.

Furthermore, in the present embodiment, since the first control mode may be executed when the dimension of the transported sheet in the width direction is smaller than the lower limit width Wc and the second control mode may be executed when the dimension of the transported sheet in the width direction is equivalent to or larger than the lower limit width Wc, the control modes may be appropriately selected.

A feature or the present embodiment is that the cutoff time Ts according to the present embodiment may be less than the time needed for the leading edge of the transported sheet in the transport direction that has reached the belt 13 to reach the image forming unit 5. Accordingly, when forming an image on a sheet, an adverse effect to the image forming process owing to transporting force given to the sheet from the separation roller 21B can be suppressed.

The present embodiment has a feature in that the first control mode may be performed by, after energizing the solenoid 34 and meshing the transmission gear 33 with the input gear 31A and the output gear 32, energizing the solenoid 34 once more and meshing the transmission gear 33 with the input gear 31A and the output gear 32.

Accordingly, in the present embodiment, without any change in the drive mechanism 31 capable of performing the second control mode that is a general control mode, the first control mode may be implemented by control of the energizing timing of the solenoid 34 only.

Other Embodiments

In the embodiment described above, the switching between a case in which the first control mode is performed and a case in which the second control mode is performed may be performed on the basis of the dimension of the sheet in the width direction; however, the disclosure is not limited to the above and, for example, the first control mode may always be executed when the sheet is supplied from the multipurpose sheet supply tray.

In the embodiment described above, the first control mode may be achieved by intermitting the transmission of torque with the drive mechanism 31 since the electric motor M supplies torque to not only the separation roller 21B but also to the other rollers.

However, the disclosure is not limited to the above and, for example, a dedicated electric motor that supplies torque to the separation roller 21B may be provided separately and the first control mode may be implemented by controlling the rotation and stoppage of the dedicated electric motor.

The first transport roller 25 and the second transport roller 27 have a registration function; however, the disclosure is not limited to the above and the first transport roller 25 and the second transport roller 27 may be simple transport rollers.

In the image forming apparatus according to the embodiment described above, a description is given with the belt 13 as an example of a transport unit provided downstream of the first transport roller 25; however, the disclosure is not limited to the above and other transport units such as a roller and a transport guide may be employed.

In the embodiment described above, a re-feeding process (S13 to S17) may be executed; however, the disclosure is not limited to the above and the re-feeding process may be dispensed of or a plurality of re-feeding processes may be performed.

In the embodiment described above, the first control mode may be executed only when the sheet is supplied from the multipurpose sheet supply tray; however, the disclosure is not limited to the above and the first control mode may be executed when the sheet is supplied from the sheet supply tray 17 as well.

In the embodiment described above, the energization time and the re-energization time may be set at time periods in which the drive mechanism 31 is in the transmission state when the leading edge of the sheet in the transport direction, the sheet transported in the transport path L1, reaches the first transport roller 25 and when the leading edge of the sheet in the transport direction reaches the belt 13 and in which the drive mechanism 31 is in the cutoff state when the cutoff time Ts has elapsed from after the leading edge of the sheet in the transport direction has reached the belt 13; however, the disclosure is not limited to the above. That is, the position of the leading edge of the sheet in the transport direction, the sheet being transported in the transport path L1, may be directly or indirectly detected and the detection result may be used to control the intermittent torque transmitted to the separation roller 21B.

In the embodiment described above, there existed a state in which transmission of torque to the separation roller 21B is cut off from when the feeding of the sheet is started to when the leading edge of the sheet in the transport direction reaches the belt 13; however, the disclosure is not limited the above.

In other words, in the disclosure, it is only sufficient that torque is transmitted to the separation roller 21B at two instances, that is, when the leading edge of the transported sheet in the transport direction reaches the first transport roller 25 and when the leading edge of the sheet in the transport direction reaches the belt 13. Accordingly, torque may be continuously transmitted to the separation roller 21B from when the feeding of the sheet is started to when the leading edge of the sheet in the transport direction reaches the belt 13.

In the embodiment described above, the disclosure is applied to an electrophotographic image forming apparatus; however, the disclosure is not limited to the above and, for example, the disclosure may be applied to an inkjet image forming apparatus as well.

A feature of the disclosure is that the drive mechanism 31 is in the cutoff state when the cutoff time Ts has elapsed from after the leading edge of the sheet in the transport direction has reached the belt 13. Accordingly, if the drive mechanism 31 is in the cutoff state before the leading edge of the sheet in the transport direction reaches the belt 13, it will be difficult for the separation roller 21B to give sufficient transporting force to the sheet.

Furthermore, the disclosure only needs to coincide with the spirit of the disclosure stipulated in the claims and the disclosure is not limited to the embodiments described above.

What is claimed is:

1. An image processing apparatus comprising:

an image processing unit disposed along a transport path;

a separation roller located along the transport path;

a frictional resistance body that is disposed at a position across the transport path from and opposing the separation roller;

a first transport roller including a first roller portion and a first shaft portion that holds the first roller portion, the first transport roller being provided along the transport path downstream of the separation roller, the first shaft portion extending entirely across the transport path in a width direction;

a second transport roller displaceably positioned across the transport path from the first transport roller to cooperatively nip the sheet, the second transport roller including a second roller portion and a second shaft portion that holds the second roller portion, the second shaft portion extending entirely across the transport path in the width direction and being displaceable away from and towards the first transport roller;

a pair of pressing members configured to press ends sides of the second transport roller towards the first transport roller;

a transport unit that is located downstream of the first transport roller along the transport path, wherein at least a portion of the transport unit is located upstream of the image processing unit along the transport path; and a drive controller configured to control the separation roller in a first control mode, wherein in the first control mode, the drive controller is configured to:

apply torque to the separation roller when a leading edge of the sheet in a transport direction reaches the first transport roller and when the leading edge of the sheet in the transport direction reaches the transport unit; and cut off torque to the separation roller after the leading edge of the sheet has reached the transport unit but before the leading edge of the sheet reaches the image processing unit.

2. The image processing apparatus according to claim 1, wherein the drive controller is further configured to apply torque to the separation roller while the leading edge of the sheet in the transport direction passes between the first transport roller and the transport unit.

3. The image processing apparatus according to claim 1, wherein the drive controller is further configured to cut off torque to the separation roller in a cut-off period, the cut-off period is a part of a period in which the leading edge of the sheet in the transport direction passes between the first transport roller and the transport unit.

4. The image processing apparatus according to claim 1, wherein the drive controller is configured to apply torque to the separation roller for a period of time after the leading edge of the sheet in the transport direction reaches the transport unit.

5. The image processing apparatus according to claim 1, wherein the image processing unit comprises an image forming unit.

6. The image processing apparatus according to claim 1, wherein the drive controller is further configured to control the separation roller in a second control mode, in the second control mode, the drive controller is configured to:

apply torque to the separation roller when the leading edge of the sheet in the transport direction reaches the first transport roller; and cut off torque to the separation roller before the leading edge of the sheet in the transport direction reaches the transport unit.

7. The image processing apparatus according to claim 6, wherein the drive controller is configured to perform the first control mode when a dimension of a transported sheet in the width direction is smaller than a predetermined dimension and perform the second control mode when the dimension of the transported sheet in the width direction is equal to or larger than the predetermined dimension.

8. The image processing apparatus according to claim 1, wherein the first transport roller and the second transport roller are registration rollers.

9. The image processing apparatus according to claim 1, wherein the drive controller includes a drive mechanism and a controller, the drive mechanism including:

an input gear configured to transmit an input torque, an output gear configured to transmit an output torque to the separation roller in response to the input torque, a transmission gear configured to receive the input torque from the input gear and to transfer the input torque to the output gear when meshed with the input gear and the output gear, the transmission gear including a portion not provided with teeth, and a solenoid actuatable to selectively mesh the transmission gear with the input gear and the output gear, wherein during performance of the first control mode, the controller is configured to actuate the solenoid to mesh the transmission gear with the input gear and the output gear.

10. The image processing apparatus according to claim 1, wherein the first transport roller is disposed directly after the separation roller in the transport direction of the sheet.

11. The image processing apparatus according to claim 1, wherein the transport path between the separation roller and the first transport roller is oriented in a same direction.

12. The image processing apparatus according to claim 1, wherein the transport path between the separation roller and the transport unit is oriented in a constant horizontal direction.

13. A method of operation of an image processing apparatus comprising an image processing unit disposed along a transport path, a separation roller located along the transport path, a frictional resistance body that is disposed at a position across the transport path from and opposing the separation roller, a first transport roller including a first roller portion and a first shaft portion that holds the first roller portion, the first transport roller being provided along the transport path downstream of the separation roller, the first shaft portion extending entirely across the transport path in a width direction, a second transport roller displaceably positioned across the transport path from the first transport roller to cooperatively nip the sheet, the second transport roller including a second roller portion and a second shaft portion that holds the second roller portion, the second shaft portion extending entirely across the transport path in the width direction and being displaceable away from and towards the first transport roller, a pair of pressing members configured to press end sides of the second transport roller towards the first transport roller, a transport unit that is located downstream of the first transport roller along the transport path, wherein at least a portion of the transport unit is located upstream of the image processing unit along the transport path, the method comprising:

applying torque to the separation roller when a leading edge of a sheet in a transport direction reaches the first transport roller and when the leading edge of the sheet in the transport direction reaches the transport unit; and cutting off torque to the separation roller after the leading edge of the sheet has reached the transport unit but before the leading edge of the sheet reaches an image processing unit.

14. A non-transitory, computer-readable media storing computer-readable instructions therein that, when executed by at least one processor of an image processing apparatus comprising an image processing unit disposed along a transport path, a separation roller located along the transport path, a frictional resistance body that is disposed at a position across the transport path from and opposing the separation roller, a first transport roller including a first roller portion and a first shaft portion that holds the first roller portion, the first transport roller being provided along the transport path downstream of the separation roller, the first shaft portion extending entirely across the transport path in a width direction, a second transport roller displaceably positioned across the transport path from the first transport roller to cooperatively nip the sheet, the second transport roller including a second roller portion and a second shaft portion that holds the second roller portion the second shaft portion extending entirely across the transport path in the width direction and being displaceable away from and towards the first transport roller, a pair of pressing members configured to press end sides of the second transport roller towards the first transport roller, a transport unit that is located downstream of the first transport roller along the transport path, wherein at least a portion of the transport unit is located upstream of the image processing unit along the transport path, cause the image processing apparatus to:

apply torque to the separation roller when a leading edge of a sheet in a transport direction reaches the first transport roller and when the leading edge of the sheet in the transport direction reaches the transport unit; and cut off torque to the separation roller after the leading edge of the sheet has reached the transport unit but before the leading edge of the sheet reaches an image processing unit.

* * * * *